US010661428B2

(12) United States Patent
Baskar et al.

(10) Patent No.: US 10,661,428 B2
(45) **Date of Patent: *May 26, 2020**

(54) POWER TOOL WITH INTERCHANGEABLE TOOL HEADS

(71) Applicant: BLACK & DECKER INC., New Britain, CT (US)

(72) Inventors: Ashok Samuel Baskar, Lutherville, MD (US); Brent A. Kuehne, Red Lion, PA (US); William G. Harman, Jr., Glen Rock, PA (US)

(73) Assignee: Black & Decker Inc., New Britiain, CT (US)

( * ) Notice: Subject to any disclaimer, the term of this patent is extended or adjusted under 35 U.S.C. 154(b) by 240 days.

This patent is subject to a terminal disclaimer.

(21) Appl. No.: 15/935,833

(22) Filed: Mar. 26, 2018

(65) Prior Publication Data

US 2018/0207785 A1 Jul. 26, 2018

Related U.S. Application Data

(63) Continuation of application No. 14/273,098, filed on May 8, 2014, now Pat. No. 9,956,677.

(Continued)

(51) Int. Cl.
*B25F 5/02* (2006.01)
*B25F 3/00* (2006.01)

(52) U.S. Cl.
CPC . *B25F 5/02* (2013.01); *B25F 3/00* (2013.01)

(58) Field of Classification Search
CPC ..... B25F 5/02; B25F 3/00

(Continued)

(56) References Cited

U.S. PATENT DOCUMENTS 1,965,669 A 7/1934 Robb
2,713,271 A 7/1955 Dodegge (Continued)

FOREIGN PATENT DOCUMENTS

CN 2074697 U 4/1991
DE 1902315 A1 9/1969

(Continued)

OTHER PUBLICATIONS

Picture of a Black & Decker Matrix AC Drill Driver Base Unit, believed to be available to the public more than one year prior to the filing of the present U.S. Appl. No. 14/273,098 and U.S. Appl. No. 61/926,453, from which the present application claims priority.

(Continued)

*Primary Examiner* — Robert F Long
(74) *Attorney, Agent, or Firm* — Stephen R. Valancius

(57) ABSTRACT

A power tool system which includes a first base unit and a second base unit. The first and second base units each include a housing, a motor housed in the housing, a coupler which is operatively connected to and selectively drivable by the motor and a trigger for activating the motor to drive the coupler. The system also includes a first attachment head which is removably couplable with both the first base unit and the second base unit so that it can be driven by the respective motor of the base unit to which it is attached and a second attachment head which is removably couplable to the first base unit, but which is not couplable with the second base unit.

20 Claims, 27 Drawing Sheets

Related U.S. Application Data

(60) Provisional application No. 61/926,453, filed on Jan. 13, 2014, provisional application No. 61/821,009, filed on May 8, 2013.

(58) Field of Classification Search
USPC ..... 173/2, 29, 46, 50, 90, 171, 213; 227/175.1–182.1
See application file for complete search history.

(56) References Cited

U.S. PATENT DOCUMENTS 2,893,175 A 7/1959 Bruck
2,898,616 A 8/1959 Coover
3,390,412 A 7/1968 Wolter
3,525,912 A 8/1970 Wallin
3,533,193 A 10/1970 Dudek
3,566,895 A 3/1971 Goto
3,638,362 A 2/1972 Stoll
3,724,237 A 4/1973 Wood
3,747,594 A 7/1973 Bishop
3,759,336 A 9/1973 Marcovitz et al.
3,761,663 A 9/1973 Brown
3,793,776 A 2/1974 Sadow, Jr. et al.
3,841,416 A 10/1974 Pfister
3,874,125 A 4/1975 Stroezel
3,899,852 A 8/1975 Batson
3,908,139 A 9/1975 Duncan, Jr.
3,952,239 A 4/1976 Owings et al.
3,973,179 A 8/1976 Weber et al.
4,050,528 A 9/1977 Foltz et al.
4,052,824 A 10/1977 Hutchins
4,091,880 A 5/1978 Troutner et al.
4,103,511 A 8/1978 Kress et al.
4,125,339 A 11/1978 Pittinger, Sr. et al.
4,251,120 A 2/1981 Wolff
RE30,680 E 7/1981 Kress et al.
4,304,071 A 12/1981 Obrecht
4,307,325 A 12/1981 Saar
4,355,251 A 10/1982 Alessio et al.
4,410,846 A 10/1983 Gerber et al.
4,504,769 A 3/1985 Fushiya et al.
4,513,381 A 4/1985 Houser, Jr. et al.
4,625,462 A 12/1986 Fushiya et al.
4,628,459 A 12/1986 Shinohara et al.
4,728,942 A 3/1988 England
4,754,575 A 7/1988 Schneider
4,827,552 A 5/1989 Bojar et al.
4,834,596 A 5/1989 Hollifield et al.
4,835,409 A 5/1989 Bhagwat et al.
4,835,410 A 5/1989 Bhagwat et al.
4,871,629 A 10/1989 Bunyea
4,962,681 A 10/1990 Yang
4,995,148 A 2/1991 Bonomi et al.
5,018,314 A 5/1991 Fushiya et al.
5,018,411 A 5/1991 La Padura
5,033,552 A 7/1991 Hu
5,128,783 A 7/1992 Abileah et al.
5,149,230 A 9/1992 Nett
5,157,873 A 10/1992 Rudolf et al.
5,241,053 A 8/1993 Fujisawa et al.
5,296,768 A 3/1994 Burger et al.
5,347,765 A * 9/1994 Mixon, Jr. ..... B23Q 3/12 279/145
5,374,088 A 12/1994 Moretti et al.
5,386,667 A 2/1995 Hausslein et al.
5,392,568 A 2/1995 Howard, Jr. et al.
5,398,454 A 3/1995 Berner
5,398,457 A 3/1995 Updegrave et al.
5,441,450 A 3/1995 Fein et al.
5,421,053 A 6/1995 Chodak
5,490,683 A 2/1996 Mickel et al.
5,563,482 A 10/1996 Shaw et al.
5,580,302 A 12/1996 Howard, Jr. et al.
5,679,066 A 10/1997 Butz et al.
5,709,595 A 1/1998 Bergner et al.
5,715,156 A 2/1998 Yilmaz et al.
5,771,516 A 6/1998 Huang
5,839,949 A 11/1998 Martin et al.
5,885,146 A 3/1999 Cockburn
5,934,139 A * 8/1999 Tucker ..... B21D 1/06 173/90
5,941,891 A 8/1999 Walen
5,988,025 A 11/1999 Sasaki et al.
6,004,194 A 12/1999 Hild et al.
6,039,126 A 3/2000 Hsieh
6,062,575 A 5/2000 Mickel et al.
6,062,960 A 5/2000 Kai et al.
6,104,162 A 8/2000 Sainsbury et al.
6,126,370 A 10/2000 Wheeler et al.
6,132,300 A 10/2000 Martin
6,153,838 A 11/2000 Wadge
6,159,084 A 12/2000 Tiede
6,170,579 B1 1/2001 Wadge
6,176,322 B1 1/2001 Wadge
6,179,696 B1 1/2001 Duffy
6,206,107 B1 3/2001 Wadge
6,224,303 B1 5/2001 Wheeler et al.
6,237,698 B1 5/2001 Carrier et al.
6,243,276 B1 6/2001 Neumann
6,244,933 B1 6/2001 Morkvenas
6,263,980 B1 7/2001 Wadge
6,270,087 B1 8/2001 Mickel et al.
6,286,609 B1 * 9/2001 Carrier ..... B25F 5/02 173/1
6,286,611 B1 9/2001 Bone
6,296,065 B1 10/2001 Carrier
6,306,024 B1 10/2001 Kai et al.
6,343,901 B2 2/2002 Wheeler et al.
6,446,734 B1 * 9/2002 Williams ..... B25F 5/02 173/1
6,460,626 B2 10/2002 Carrier
6,488,710 B2 12/2002 Besselink
6,502,949 B1 1/2003 Horiyama et al.
6,553,642 B2 4/2003 Driessen
6,573,621 B2 6/2003 Neumann
6,601,621 B2 8/2003 Wixey et al.
6,613,089 B1 9/2003 Estes et al.
6,634,439 B2 10/2003 Driessen
6,641,467 B1 * 11/2003 Robson ..... B23D 51/01 29/560
6,675,911 B2 1/2004 Driessen
6,675,912 B2 1/2004 Carrier
6,708,744 B2 3/2004 Wixey et al.
6,780,094 B2 8/2004 Walker
6,875,095 B2 4/2005 Walker
6,886,615 B2 5/2005 Wixey et al.
6,910,694 B2 6/2005 Hartmann et al.
6,918,419 B2 7/2005 Wixey et al.
7,021,399 B2 4/2006 Driessen
7,048,617 B1 5/2006 Spiva
7,114,824 B2 10/2006 Picone
7,198,559 B2 4/2007 Walstrum et al.
7,220,174 B2 5/2007 Phillips et al.
7,235,005 B2 6/2007 Schnell et al.
7,270,591 B2 9/2007 Deshpande et al.
7,270,910 B2 9/2007 Yahnker et al.
7,371,150 B2 5/2008 Deshpande et al.
7,428,917 B2 9/2008 Wixey et al.
7,526,833 B2 5/2009 Cochran et al.
7,568,867 B2 8/2009 Bryan
7,609,025 B2 10/2009 Griffin
7,649,337 B2 1/2010 Uehlein-Proctor et al.
7,653,963 B2 2/2010 Cochran et al.
7,713,110 B2 5/2010 Lampka et al.
7,719,230 B2 5/2010 Griffin
7,722,435 B2 5/2010 King
7,736,216 B2 6/2010 King et al.
7,743,683 B2 6/2010 Dayton et al.
7,770,660 B2 8/2010 Schroeder et al.
7,815,356 B2 10/2010 Lutz et al.
7,825,615 B2 11/2010 Chen et al.
7,828,630 B2 11/2010 Robson et al.
7,913,345 B2 3/2011 Dayton et al.

(56) References Cited

U.S. PATENT DOCUMENTS

| | | | | |
|---|---|---|---|---|
| 7,926,141 | B2 | 4/2011 | Dayton et al. | |
| 8,172,642 | B2 | 5/2012 | King et al. | |
| D665,644 | S | 8/2012 | McRoberts | |
| D665,645 | S | 8/2012 | McRoberts et al. | |
| 8,398,457 | B2 | 3/2013 | King et al. | |
| D692,741 | S | 11/2013 | McRoberts et al. | |
| D694,605 | S | 12/2013 | Reth et al. | |
| 8,613,644 | B2 | 12/2013 | King et al. | |
| 2001/0042631 | A1* | 11/2001 | Carrier | B25F 5/02 173/217 |
| 2002/0050366 | A1* | 5/2002 | Driessen | B25F 3/00 173/216 |
| 2002/0050368 | A1* | 5/2002 | Driessen | B25F 3/00 173/217 |
| 2002/0134811 | A1* | 9/2002 | Napier | B24B 23/04 227/131 |
| 2002/0148623 | A1* | 10/2002 | Pan | B25F 3/00 173/217 |
| 2003/0097178 | A1 | 5/2003 | Roberson et al. | |
| 2003/0109207 | A1 | 6/2003 | Wuensch | |
| 2003/0130742 | A1 | 7/2003 | Connelly et al. | |
| 2003/0200640 | A1* | 10/2003 | Bifrare | G04D 3/04 29/231 |
| 2004/0220672 | A1 | 11/2004 | Shadduck | |
| 2005/0076972 | A1 | 4/2005 | Wixey et al. | |
| 2006/0019585 | A1 | 1/2006 | Zayat et al. | |
| 2006/0091858 | A1* | 5/2006 | Johnson | B25F 5/00 320/128 |
| 2006/0146571 | A1 | 7/2006 | Whitney | |
| 2007/0095149 | A1 | 5/2007 | Sieber et al. | |
| 2008/0311832 | A1 | 12/2008 | King | |
| 2009/0010725 | A1 | 1/2009 | Egelund | |
| 2009/0126964 | A1 | 5/2009 | Schroeder et al. | |
| 2009/0239451 | A1 | 9/2009 | Geiser et al. | |
| 2010/0032179 | A1* | 2/2010 | Hanspers | B25F 3/00 173/11 |
| 2010/0048101 | A1 | 2/2010 | King et al. | |
| 2010/0146797 | A1 | 6/2010 | Dreher | |
| 2010/0288520 | A1 | 11/2010 | Dayton et al. | |
| 2010/0328929 | A1 | 12/2010 | Lutz et al. | |
| 2011/0036604 | A1 | 2/2011 | Worsnop et al. | |
| 2011/0094763 | A1 | 4/2011 | Wei | |
| 2011/0100661 | A1 | 5/2011 | Wei | |
| 2011/0100662 | A1 | 5/2011 | Wei | |
| 2011/0100663 | A1 | 5/2011 | Wu | |
| 2011/0108298 | A1 | 5/2011 | Zhou | |
| 2011/0108299 | A1 | 5/2011 | Wei | |
| 2011/0121782 | A1 | 5/2011 | Marsh et al. | |
| 2011/0174099 | A1* | 7/2011 | Ross | A61B 17/00 74/89.32 |
| 2011/0272172 | A1 | 11/2011 | Lau et al. | |
| 2012/0116388 | A1* | 5/2012 | Houser | A61N 7/00 606/41 |
| 2013/0008677 | A1 | 1/2013 | Huifu | |
| 2013/0020103 | A1 | 1/2013 | McClaskey et al. | |
| 2013/0020106 | A1* | 1/2013 | Kuehne | B25F 3/00 173/214 |
| 2013/0025108 | A1* | 1/2013 | Ng | F16G 3/003 29/432 |
| 2013/0118767 | A1 | 5/2013 | Cannaliato et al. | |
| 2013/0228355 | A1 | 9/2013 | Kuehne et al. | |
| 2014/0024301 | A1 | 1/2014 | King et al. | |
| 2014/0190017 | A1* | 7/2014 | Maynez | B25F 5/00 30/276 |
| 2015/0053749 | A1* | 2/2015 | Shelton, IV | G16H 40/63 227/181.1 |
| 2015/0216525 | A1* | 8/2015 | Collins | H05K 7/06 227/176.1 |
| 2015/0343583 | A1* | 12/2015 | McRoberts | B23Q 5/045 173/213 |
| 2016/0020443 | A1* | 1/2016 | White | H02J 7/02 318/245 |
| 2016/0242779 | A1* | 8/2016 | Aranyi | A61B 17/07207 |
| 2019/0259984 | A1* | 8/2019 | Nishikawa | H01M 10/425 |

FOREIGN PATENT DOCUMENTS

| | | | |
|---|---|---|---|
| DE | 2748502 | A1 | 5/1979 |
| DE | 2933355 | A1 | 3/1981 |
| DE | 3142749 | A1 | 5/1982 |
| DE | 3538225 | A1 | 4/1987 |
| DE | 19617572 | A1 | 11/1997 |
| EP | 0022222 | A1 | 1/1981 |
| EP | 0033161 | A1 | 8/1981 |
| EP | 0086114 | A1 | 8/1983 |
| EP | 0542667 | A2 | 5/1993 |
| EP | 0610801 | A1 | 8/1994 |
| EP | 0906812 | A2 | 4/1999 |
| EP | 1584412 | A2 | 10/2005 |
| EP | 2338644 | A2 | 6/2011 |
| FR | 2568377 | A1 | 1/1986 |
| GB | 2073062 | A | 10/1981 |
| JP | 10286772 | A | 10/1998 |
| WO | WO-2001096067 | A1 | 12/2001 |
| WO | WO-2005070624 | A1 | 8/2005 |

OTHER PUBLICATIONS

Picture of a Black & Decker Matrix AC Drill Driver with Matrix Drill Attachment attached, believed to be available to the public more than one year prior to the filing of the present U.S. Appl. No. 14/273,098 and believed to be available to the public more than one year prior to the filing U.S. Appl. No. 61/926,453, from which the present application claims priority.

Picture of a Black & Decker Matrix 20V Cordless Drill Base Unit, believed to be available to the public more than one year prior to the filing of the present U.S. Appl. No. 14/273,098 and believed to be available to the public more than one year prior to the filing U.S. Appl. No. 61/926,453, from which the present application claims priority.

Picture of a Black & Decker Matrix 20V Cordless Drill with Matrix Drill Attachment attached, believed to be available to the public more than one year prior to the filing of the present U.S. Appl. No. 14/273,098 and believed to be available to the public more than one year prior to the filing U.S. Appl. No. 61/926,453, from which the present application claims priority.

Picture of a Black & Decker Matrix 12V Cordless Drill Base Unit, believed to be available to the public more than one year prior to the filing of the present U.S. Appl. No. 14/273,098 and believed to be available to the public more than one year prior to the filing U.S. Appl. No. 61/926,453, from which the present application claims priority.

Picture of a Black & Decker Matrix 12V Cordless Drill Base unit with Matrix Drill Attachment attached, believed to be available to the public more than one year prior to the filing of the present U.S. Appl. No. 14/273,098 and believed to be available to the public more than one year prior to the filing U.S. Appl. No. 61/926,453, from which the present application claims priority.

Picture of Black & Decker Matrix Drill Attachment, believed to be available to the public more than one year prior to the filing of the present U.S. Appl. No. 14/273,098 and believed to be available to the public more than one year prior to the filing U.S. Appl. No. 61/926,453, from which the present application claims priority. Couplable to the Black & Decker Matrix AC Drill Driver Base Unit, the Black & Decker Matrix 20V Cordless Drill Base Unit and the Black & Decker Matrix 12V Cordless Drill Base Unit.

Picture of Black & Decker Matrix Sander Attachment, believed to be available to the public more than one year prior to the filing of the present U.S. Appl. No. 14/273,098 and believed to be available to the public more than one year prior to the filing U.S. Appl. No. 61/926,453, from which the present application claims priority. Couplable to Black & Decker Matrix AC Drill Driver Base Unit, the

(56) References Cited

OTHER PUBLICATIONS

Black & Decker Matrix 20V Cordless Drill Base Unit and the Black & Decker Matrix 12V Cordless Drill Base Unit.

* cited by examiner

POWER TOOL WITH INTERCHANGEABLE TOOL HEADS

CROSS-REFERENCE TO RELATED APPLICATIONS

This is a continuation application of U.S. application No. 14/273,098 filed May 8, 2014, which claims the benefit of U.S. Provisional Application No. 61/926,453 filed Jan. 13, 2014 and U.S. Provisional Application No. 61/821,009 filed May 8, 2013, the entire disclosures of which are incorporated herein by reference.

BACKGROUND OF THE INVENTION

In order to increase the ease of use and flexibility, some handheld power tools have allowed interchangeability of tool heads. Permitting interchangeability of the tool heads, while keeping the same tool body, allows for the same tool body to operate as a variety of different tools—such as a drill, drill/driver, circular saw, sander, jigsaw, etc.

It has further been known to have more than one tool body which will receive a particular tool head, for example having one tool body that is corded and another that is a battery operated cordless tool body.

It may be beneficial to provide an improved power tool system with interchangeable tool heads which can selectively fit onto various of the available tool bodies.

SUMMARY OF THE INVENTION

According to one aspect of the invention, there is a power tool system including a first power tool base unit and a second power tool base unit, each of the first and second power tool base units including a housing and a motor surrounded by the housing; a first coupler operably connected to the motor; and a trigger for activating the motor. The power tool system may further include a first attachment head, the first attachment head including a second coupler and being removably couplable to the first power tool base unit and also being removably couplable the second power tool base unit, the second coupler being coupled together with the respective first coupler when the attachment head is attached to one of the base units. The power tool system further including a second attachment head, the second attachment head also including a second coupler and being removably couplable to the first power tool base unit; the second attachment head not being removably couplable to the second power tool base unit.

The first power tool base unit may be a cordless unit and the second power tool base unit may be a corded unit.

The first power tool base unit may be a cordless unit with a first motor and the second power tool base unit may be a cordless unit with a second motor, the second motor being different than the first. The second motor may have more power than the first motor.

The first attachment head may be a drill head and the second attachment head may be a shear shrubber head.

According to another aspect, an embodiment of the application comprises a power tool system including a first base unit including a first housing, a first motor housed in the first housing and a first coupler operatively connected to and selectively drivable by the first motor. The power tool system further includes a second base unit including a second housing, a second motor housed in the second housing and a second coupler operatively connected to and selectively drivable by the second motor. The power tool system further includes a first attachment head including a third coupler, the first attachment head being removably couplable with the first base unit such that when the first attachment head is coupled to the first base unit, the third coupler is coupled with the first coupler, the first attachment head being removably couplable with the second base unit such that when the first attachment head is coupled to the second base unit, the third coupler is coupled with the second coupler. This embodiment further includes a second attachment head including a fourth coupler, the second attachment head being removably couplable with the first base unit such that when the second attachment head is coupled to the first base unit, the fourth coupler is coupled with the first coupler. The second attachment head is not removably couplable with the second base unit.

The first coupler may be identical to the second coupler and the third coupler may be identical to the fourth coupler.

The second attachment head may include a lockout protrusion.

The first base unit may include a lockout recess which receives the lockout protrusion when the second attachment head is coupled to the first base unit.

The second base unit may include an abutting member which prevents the second attachment head from being coupled to the second base unit.

One of the first power tool base unit and the second attachment head may include a lockout protrusion and the other of the first power tool base unit and the second attachment head includes a lockout recess and the lockout recess may receive the lockout protrusion when the second attachment head is coupled to the first power tool base unit.

The first power tool base unit may be a cordless unit and the second power tool base unit may be a corded unit.

The first motor may have a different design than the second motor.

The first motor is may be a DC motor and the second motor may be an AC motor.

The first attachment head may be a drill tool head.

According to another aspect, there is a power tool system including a first base unit including a first housing, a first motor housed in the first housing and a first coupler operatively connected to the first motor and a first trigger for activating the first motor so that it drives the first coupler. A second base unit includes a second housing, a second motor housed in the second housing and a second coupler operatively connected to the second motor and a second trigger for activating the second motor so that it drives the second coupler. A first attachment head includes a third coupler, the first attachment head being removably couplable with the first power tool base unit such that when the first attachment head is coupled to the first power tool base unit, the third coupler is coupled with the first coupler and can be driven by the first motor. A second attachment head includes a fourth coupler, the second attachment head being removably couplable with the first power tool base unit such that when the second attachment head is coupled to the first power tool base unit, the fourth coupler is coupled with the first coupler and can be driven by the first motor. The first attachment head is also removably couplable with the second power tool base unit such that when the first attachment head is coupled to the second power tool base unit, the third coupler is coupled with the second coupler and can be driven by the first motor. The second attachment head is not removably couplable with the second power tool base unit.

One of the first power tool base unit and the second attachment head may include lockout protrusion and the other of the first power tool base unit and the second attachment head may include a lockout recess and the lockout recess receives the lockout protrusion when the second attachment head is coupled to the first power tool base unit.

The second attachment head may include the lockout protrusion and the lockout protrusion prevents the second attachment head from being coupled to the second power tool base unit.

The first power tool base unit may be a cordless unit and the second power tool base unit may be a corded unit.

The first attachment head may include a sander tool head.

The first attachment head may include a saw tool head.

The first attachment head may include a drill tool head.

According to another aspect, there is a power tool system including a first base unit including a first housing, a first motor housed in the first housing and a first coupler operatively connected to and selectively drivable by the first motor. The system further includes a second base unit including a second housing, a second motor housed in the second housing and a second coupler operatively connected to and selectively drivable by the second motor. The system further includes a third base unit including a third housing, a third motor housed in the third housing and a third coupler operatively connected to and selectively drivable by the third motor. The system further includes a first attachment head including a fourth coupler, the first attachment head being removably couplable with the first base unit such that when the first attachment head is coupled to the first base unit, the fourth coupler is coupled with the first coupler, the first attachment head being removably couplable with the second base unit such that when the first attachment head is coupled to the second base unit, the fourth coupler is coupled with the second coupler and the first attachment head being removably couplable with the third base unit such that when the first attachment head is coupled to the third base unit, the fourth coupler is coupled with the third coupler. The system further includes a second attachment head including a fifth coupler, the second attachment head being removably couplable with the first base unit such that when the second attachment head is coupled to the first base unit, the fifth coupler is coupled with the first coupler and the second attachment head being removably couplable with the second base unit such that when the second attachment head is coupled to the second base unit, the fifth coupler is coupled with the second coupler. The system further includes a third attachment head including a sixth coupler, the third attachment head being removably couplable with the first base unit such that when the third attachment head is coupled to the first base unit, the sixth coupler is coupled with the first coupler. The second attachment head is not removably couplable with the third base unit. The third attachment head is not removably couplable with the second base unit and is not removably couplable with the third base unit.

The first attachment head may be a saw tool head.

The first attachment head may be a drill tool head.

DETAILED DESCRIPTION OF EXEMPLARY EMBODIMENTS

Figure 1:
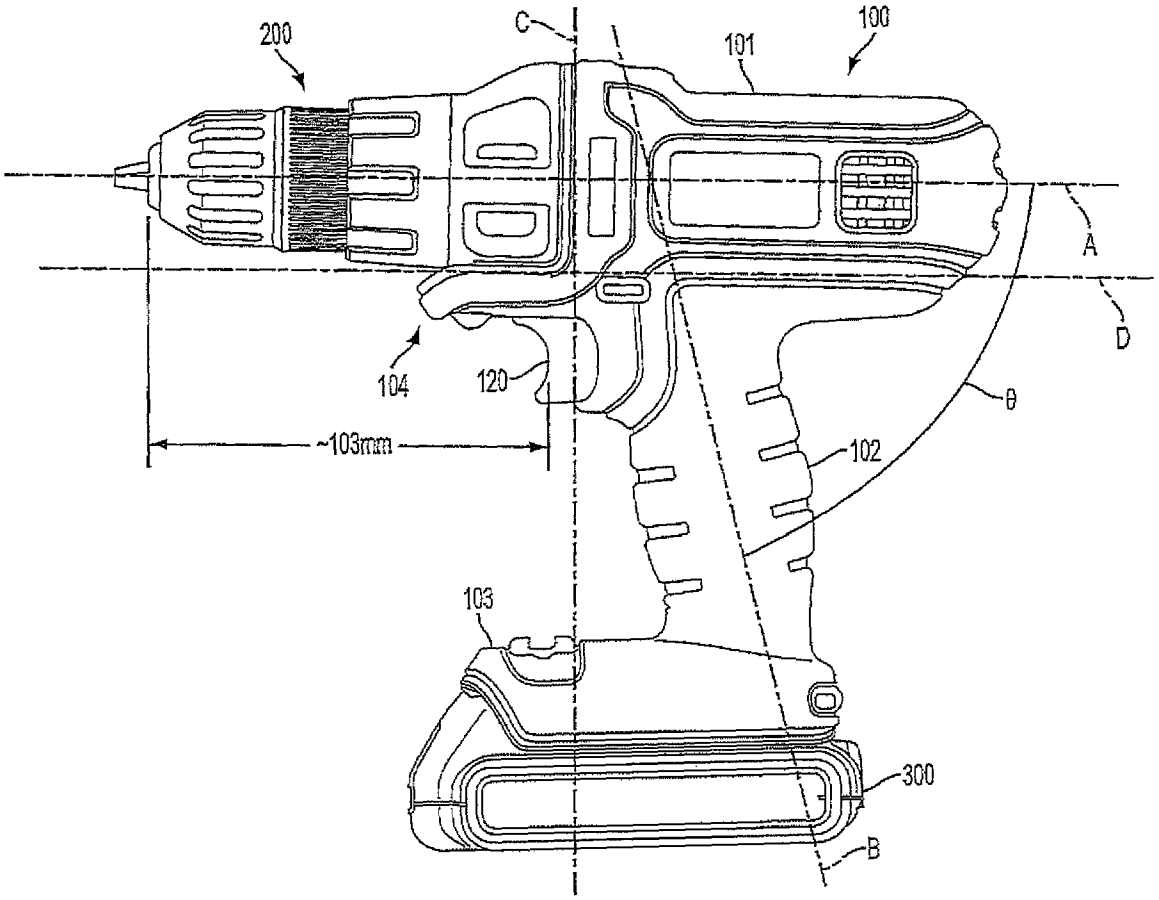
FIG. 1 is a side view of a power tool according to an exemplary embodiment of the invention with a drill head attached.
Figure 2:
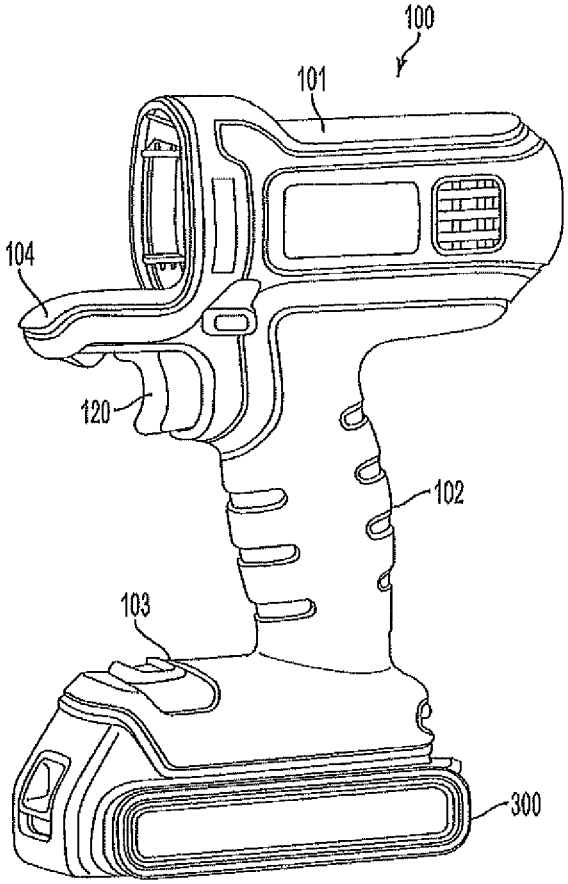
FIG. 2 illustrates the power tool with the tool head detached.
Figure 3:
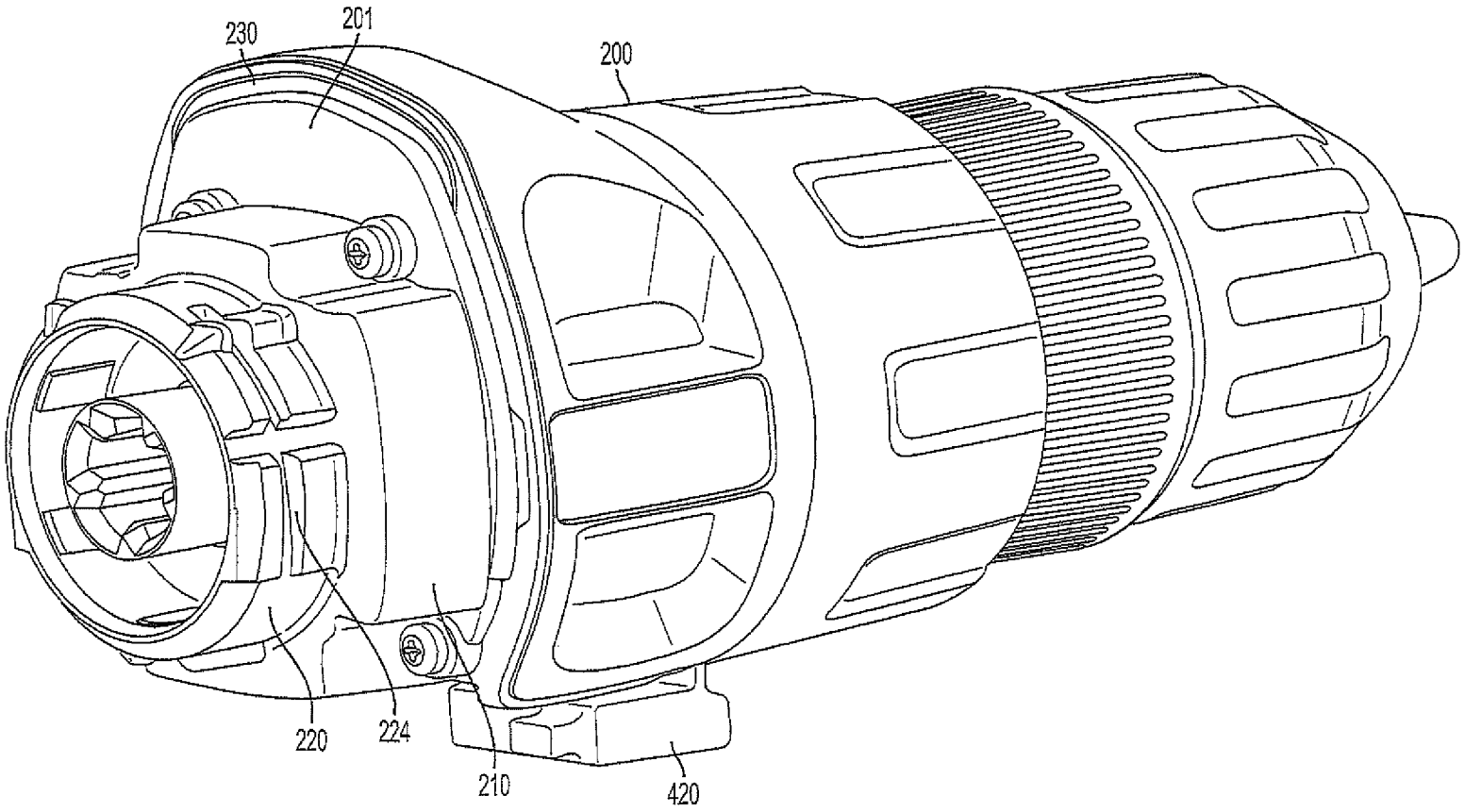
FIG. 3 illustrates a drill head tool head attachment.

The exemplary embodiments of the present application are related to power tools having base tool bodies with interchangeable heads. This general type of tool has been previously shown in, for example, FIGS. 1-3 show an exemplary embodiment of a power tool according to the present application. FIG. 1 illustrates a cordless power tool base unit (tool body) with a drill as the power tool head. FIG. 2 shows the base unit alone and FIG. 3 shows the drill tool head alone.

As shown in FIGS. 1-3, the tool comprises a tool base unit 100 and a removably attached tool head 200. In this case the tool head 200 is a drill head. The tool base unit 100 includes a motor housing portion 101 a handle 102 extending from the motor housing portion and a foot 103 at the far end of the handle 102. The tool base unit 100 further includes a ledge 104 that helps to support the drill head 200. A trigger 120 is used to activate the motor 400.

As shown in FIG. 1, the motor housing has a longitudinal axis A. The longitudinal axis A is co-incident with the longitudinal axis of the motor housed in the motor housing 101. Additionally, the handle 102 has a longitudinal axis B. According to the exemplary embodiment, the handle 102 is located substantially mid-way between a front end and a rear end of the motor housing 101 and is substantially perpendicular to the motor housing 101. According to exemplary embodiments of the application, the angle θ between the longitudinal axis of the handle B and the longitudinal axis A of the motor housing 101 may be between 50 and 120 degrees. In FIG. 1, the handle 102 is substantially perpendicular to the motor housing 101 and it is contemplated that exemplary embodiments of the tool which have an angle θ between 65 and 115 degrees, and particularly between 70 and 110 degrees, provide good ergonomics for at least the drill tool head 200.

Figure 13:
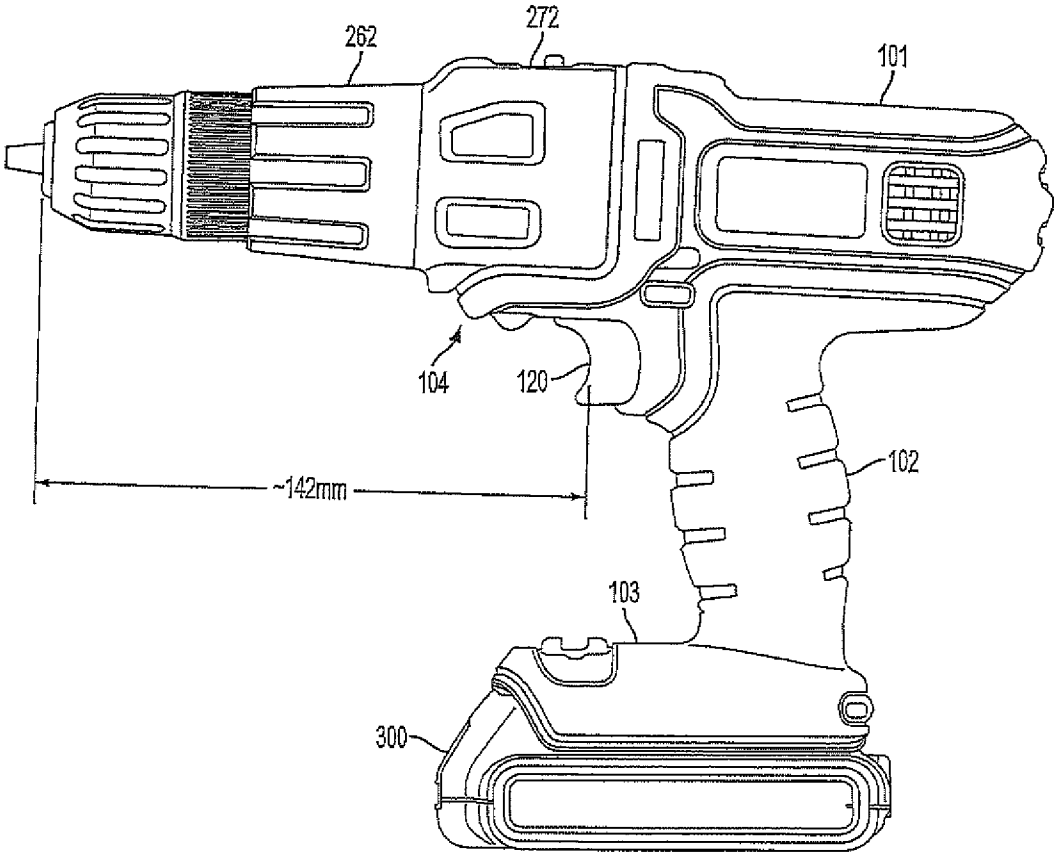
FIG. 13 is a side view of a power tool according to an exemplary embodiment of the invention with a two speed hammer drill head attached.

Typical power tools have only a single configuration and any tool head is not readily removable and interchangeable with other tool heads. Because the tool heads in such typical power tools are simply integrated into the power tool, the tool head is held in place by non-removable construction. In a power tool system with removable and interchangeable heads the tool head is removable and therefore not attached in the permanent manner of stand alone power tools. In an exemplary embodiment of the present application, there is provided a power tool system with a base unit with a ledge 104 which is substantially parallel to an axis of the motor 400 and/or the longitudinal axis A of the motor housing. The tool ledge 104 allows the tool to have a single mid-handle 102 that is angled with respect to the longitudinal axis A of the motor housing, while sufficiently supporting the tool head. Having a ledge 104 of this type also allows for a good portion of the tool head to be exposed so that controls can be exposed for the user on another side of the tool head (see, for example, the two speed hammer drill head 262 having a gear change shifter 272 as shown in FIG. 13). The design also allows for tool shapes such as the trim saw shown in FIG. 16 without unnecessarily increasing the distance between the power tool trigger and the work surface.

The drill head 200 and the tool base unit 100 meet at an interface C. The ledge 104 extends forward from this interface C generally along line D and a line running through the interface intersects the trigger 120.

Figure 4:
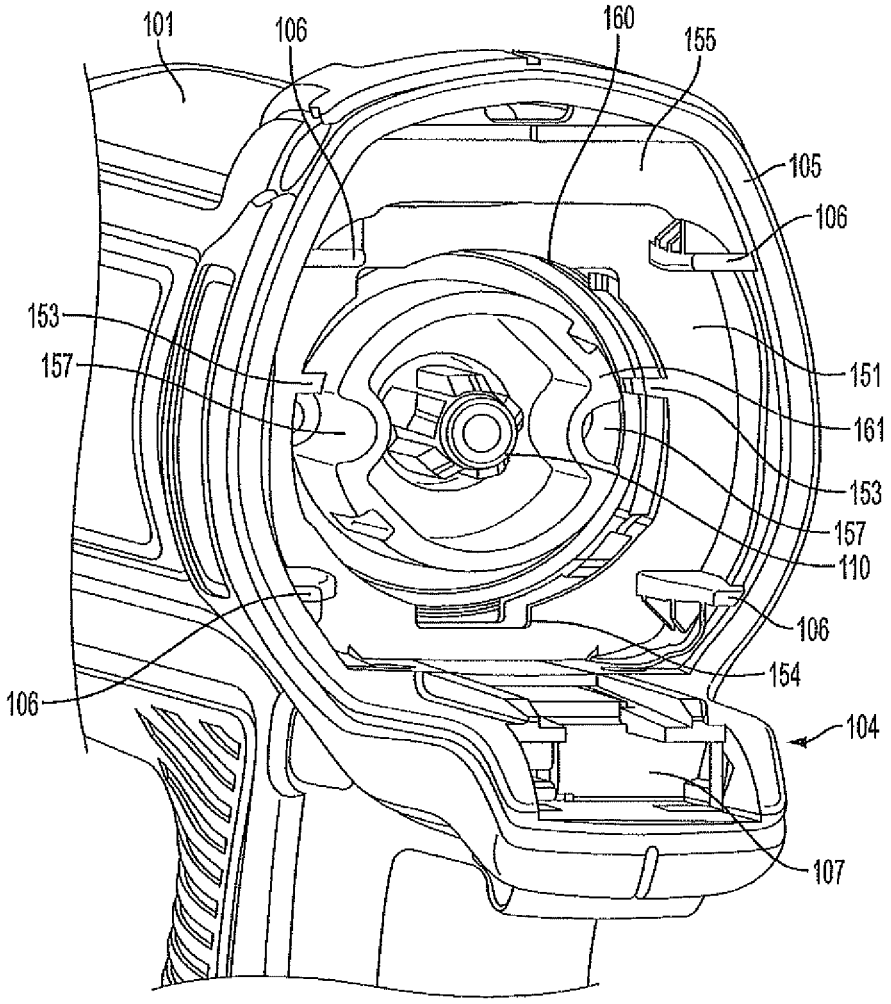
FIG. 4 is a perspective view of a coupling portion of the power tool base unit.
Figure 5:
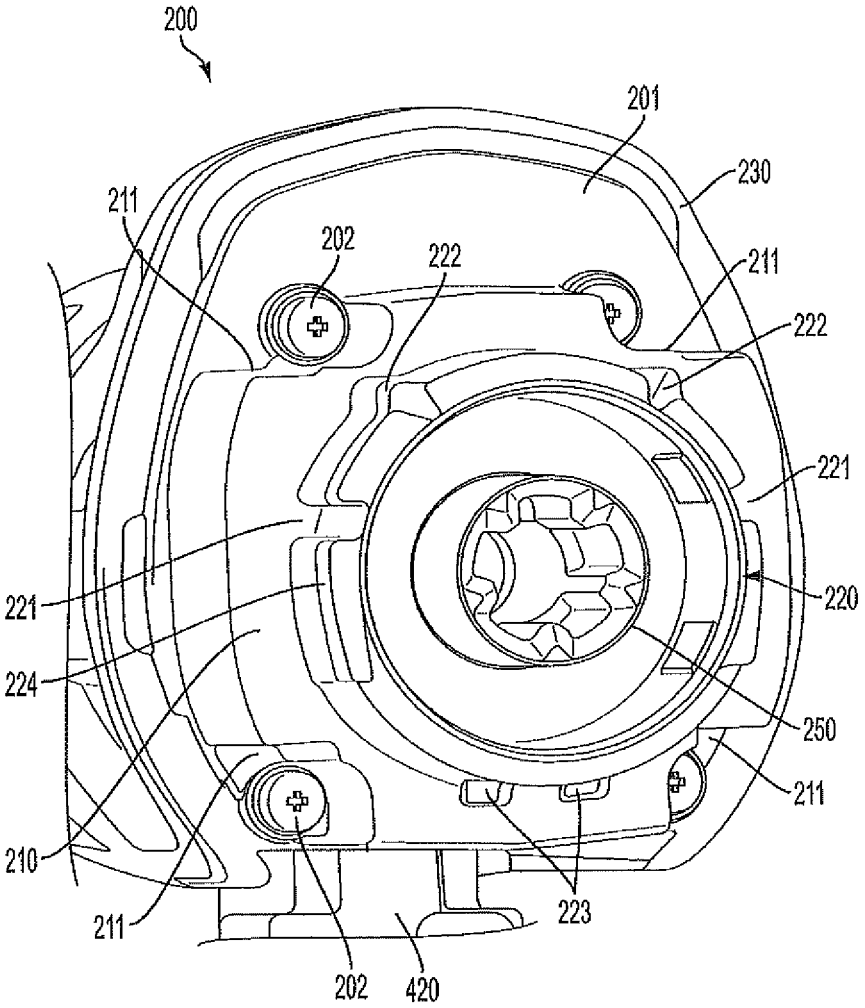
FIG. 5 is a perspective view of a coupling portion of the tool head.

FIGS. 4 and 5 illustrate the coupling features of the tool base unit 100 and the tool head 200, respectively, in more detail. As shown in FIG. 4, the tool base unit 100 has a front face 105 of the motor housing 101. The front face 105 of the motor housing abuts against the rear face 230 of the drill head 200. The plane in which the front face 105 and the rear face 230 meet forms the interface C of FIG. 1.

As seen in FIG. 4, the base unit 100 has a generally circular opening 150 into which a coupling portion of the tool head 200 can be fit. Inside the circular opening 150, there is also a motor mount opening 160 which exposes the motor mount 161. A male coupler 110 which is coupled to the motor and spins with the motor shaft is at a center of the motor mount 161. The male coupler 110 transfers mechanical power from the tool base unit 100 to the tool head 200. Adjacent to the motor mount opening 160 is a first recessed face 151. The first recessed face 151 has several features for mating with the tool head 200, including slots 152, ribs 153 and cutout 154. There is a second recessed face 155 in a direction towards the tool head 200 and a plurality of ribs 106 at corners of the first recessed face 151.

Furthermore, as can be seen in FIG. 4, the ledge 104 has an opening 107 for receiving a contact plate 420 of the tool head 200. The contact plate 420 contacts a plate member 430 and together they serve as a lock-out as described in further detail in U.S. Patent Application 61/508,962, which is hereby incorporated by reference (the same reference numbers are not used in application 61/508,962 as in the present application).

The coupling portion of the tool head 200 is shown in FIG. 5. As shown in FIG. 5, the tool head 200 has a rear face 230 that abuts the front face 105 of the tool head when the tool head 200 is coupled to the tool base unit 100. Additionally, the tool head has a plate 201 that is screwed onto the rear face 230 with screws 202. A first protrusion 210 protrudes from the plate 201 towards the tool base unit 100. There are four receiving corners or slots 211 which receive the ribs 106 of the tool base unit 100.

The tool head 200 coupling portion further includes a second protrusion portion 220 which extends from the first protrusion 210. The second protrusion portion 220 is generally cyrlindrical in shape. It includes slots 221, protrusions 222 and ribs 223. It further includes a recess 224 which receives a spring 425 (see FIG. 6). When coupled to the tool base unit 100, the slots 221 receive the ribs 153, the protrusions 222 fit in the slots 152 and the ribs 223 slide into the cutout 154. Furthermore, the tool head 200 includes a female coupler 250 which engages the male coupler 110 of the tool base unit. Additionally, the spring 425 sets into the recess 224 to axially lock the tool head 200 in place. The spring 425 and recess 224 of the present application operate similarly to the spring and recess combination shown in U.S. Pat. No. 6,634,439, which is hereby incorporated by reference. While this exemplary embodiment shows the base unit coupler 110 being male and the tool head coupler 250 being female, these could be reversed. Similarly, the other various mating features could be reversed.

As shown in the exemplary embodiment, the features of the plate 201 directly mate with those of the motor mount 161. As can be appreciated, in a tool system with interchangeable heads according to an exemplary embodiment of the present application, the male coupler 110 is aligned with the female coupler 250 in order to transfer drive from the motor 400 to the tool head 200 and the output of the tool head 200. In the present exemplary embodiment, the motor 400 is clamped tightly into the motor housing 101 and the male coupler 110 and female coupler 250 have to be closely aligned. By making the tolerance alignment features on the plate 201 and the motor mount 161, as described above, unnecessary tolerance stack-up (as may be seen if the outside of the motor housing 101 were used for tolerance alignment) is avoided. That is, at least some of the features on the plate 201 and the motor mount 161 are used as alignment features. If features on the outside of housing of the drill head 200 were used in conjunction with features on the motor housing 101 to align the tool head 200 and the tool base unit 100, there can be a much more significant tolerance stack-up, because of the number of assembled parts between the alignment features and the male and female couplers 110, 250, which are aligned to transfer power from the motor 400 to the tool head 200.

Figure 6:
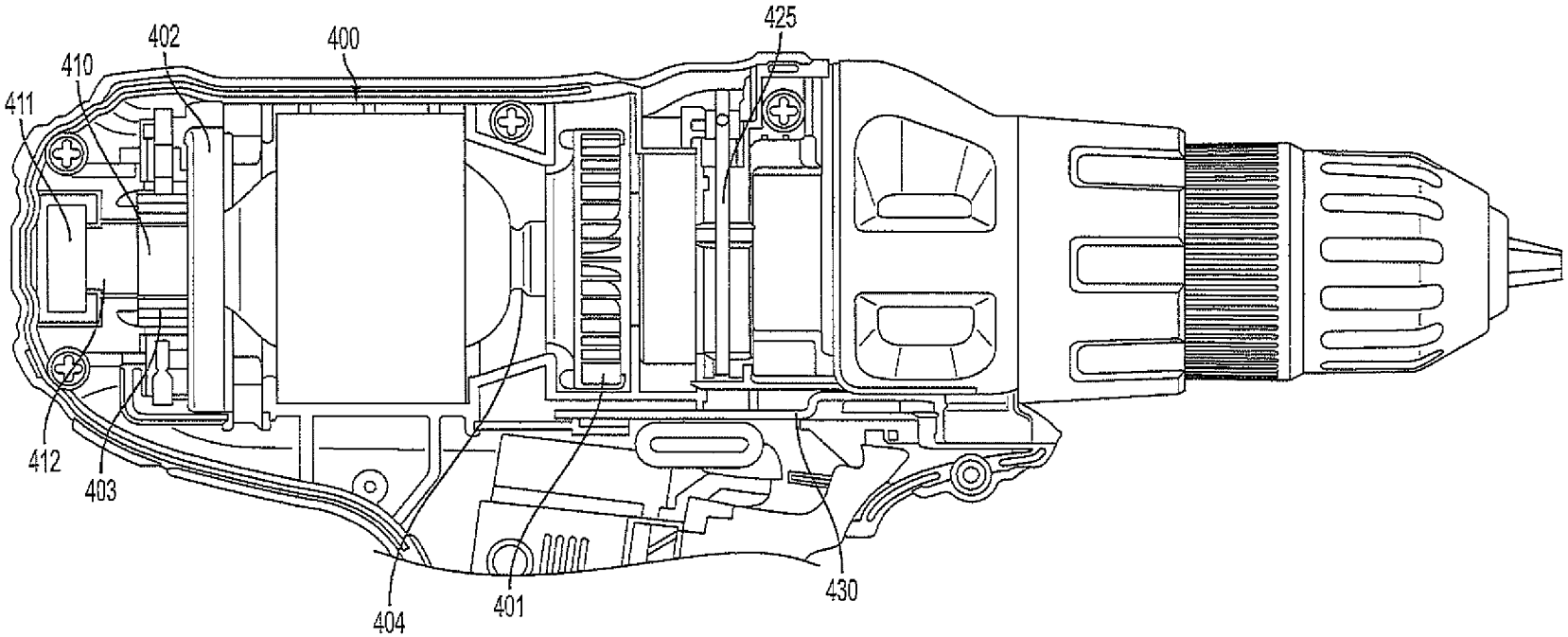
FIG. 6 is a cut-away view showing the internals of the base unit with the drill tool head attached.
Figure 7:
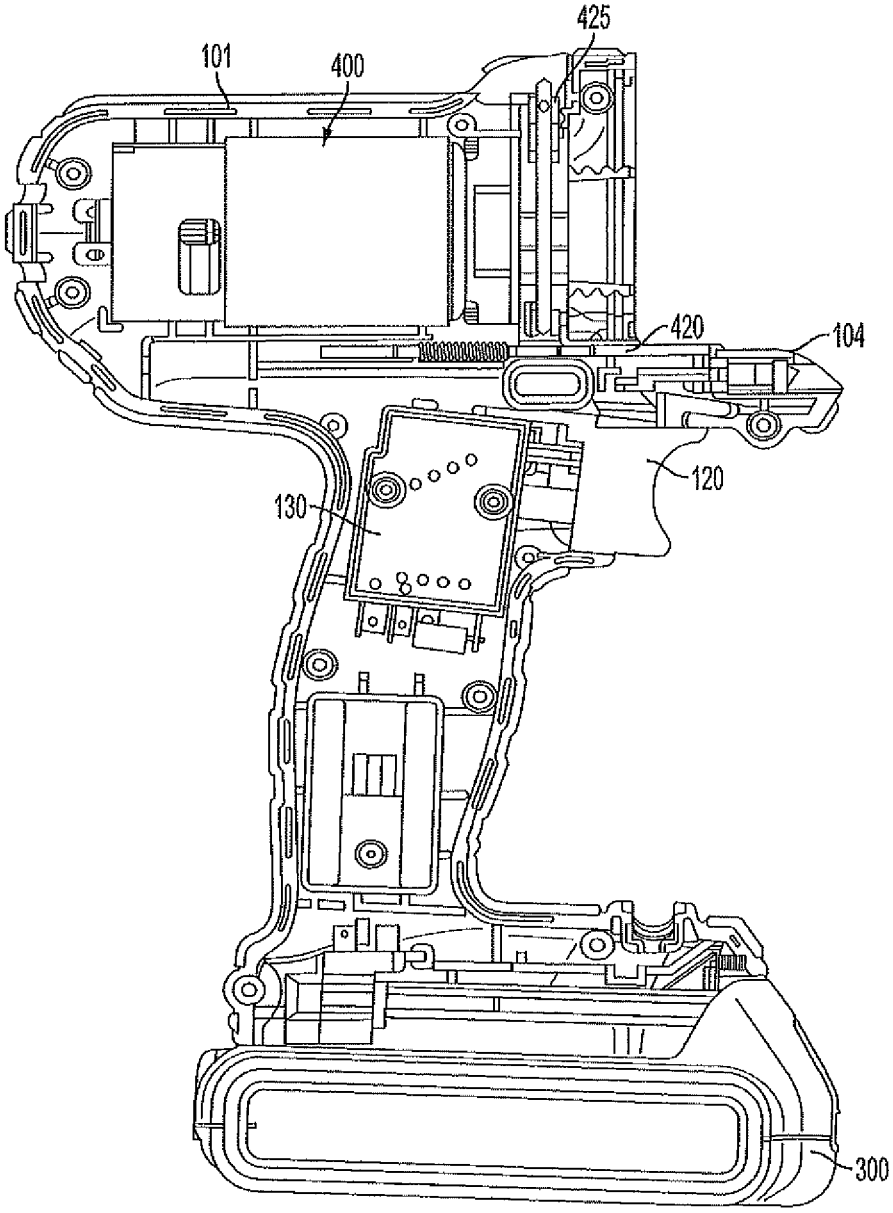
FIG. 7 is a cut-away view showing the internals of the base unit with the drill tool head detached.
Figure 8:
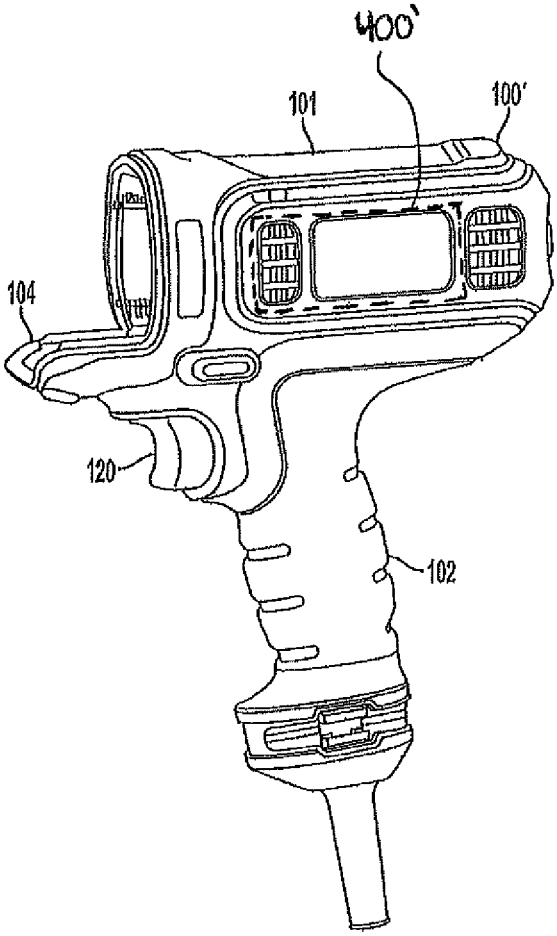
FIG. 8 is a perspective view of a corded base unit.
Figure 9:
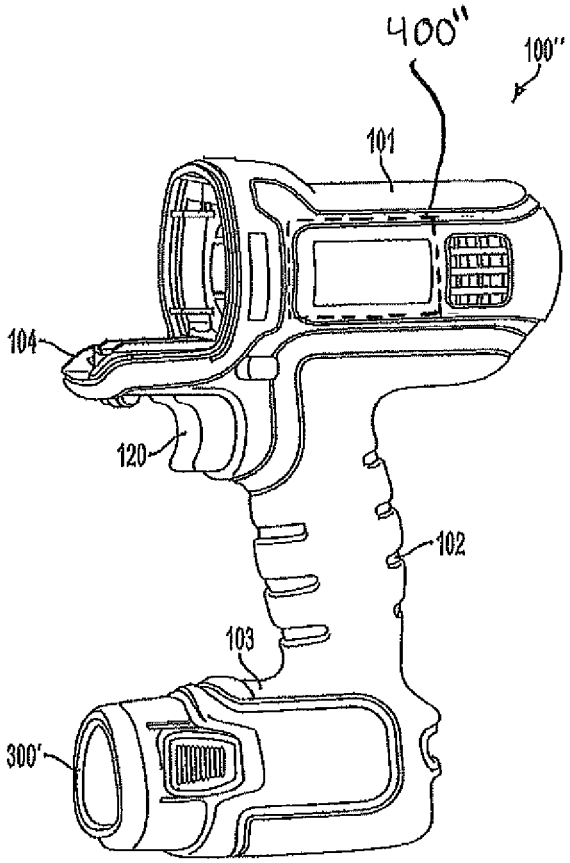
FIG. 9 is a perspective view of a cordless base unit which receives a 3-cell battery pack.

FIGS. 6 and 7 show internals of the base unit 100 (the base units 100' of FIGS. 8 and 100" of FIG. 9 includes similar internal features). As shown in these figures, the base unit 100 of the tool has a motor 400 (in the exemplary embodiment of FIG. 1 a DC motor; in the exemplary embodiment of FIG. 8 an AC motor). The motor 400 has a motor fan 401 at its front end for dissipating heat. The exemplary motor additionally has a brush ring 402 and a commutator 403. An output shaft 404 extends from the motor and provides drive to the male coupler 110. At its rear end, the motor 400 is supported by a shaft 410 which is partially covered by insulation 412. The shaft 410 may be integral and continuous with shaft 404 or may be a separate second shaft. At the rear end of the shaft 410, there is a bearing 411 supported in the housing. The motor 400 is activated by the variable speed trigger 120 and provides power to the base unit coupler 110.

As shown in FIG. 7, the trigger 120 is attached to a switch 130. Pulling the trigger 120 activates the switch 130 which in turn causes power to be provided to the motor. In this embodiment, the switch 130 and trigger 120 are variable speed, such that the speed of the motor 400 can be varied by pulling the trigger 120 more or less.

Figure 11:
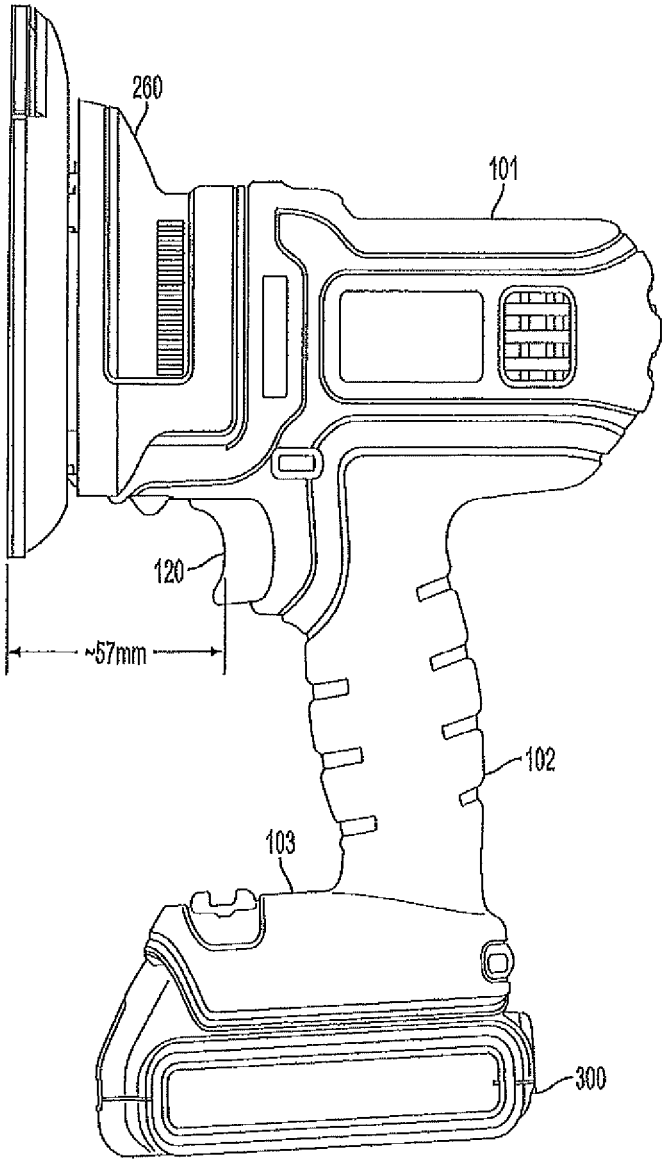
FIG. 11 is a side view of a power tool according to an exemplary embodiment of the invention with a sander head attached.

As shown in FIGS. 8 and 9, more than one type of tool base unit is contemplated. FIG. 1 shows a power tool base unit 100 which receives a slide-type battery pack 300. FIG. 8, on the other hand, is a corded base unit 100' and receives AC power and has an AC motor. For the corded base unit 100' shown in FIG. 8, the area at the bottom of the handle near where the cord is located is considered a foot. There may also be base units with different types of battery packs. For example, FIG. 9 shows a base unit 100" which receives a 3-cell type battery pack. Other battery packs, such as a tower pack, are also contemplated. The battery packs may differ both in the mechanical interface and power/voltage. Additionally, the same tool head may fit into each of the different base units 100, 100' and 100". For example, the drill head 200 with the coupling show in FIG. 4 may fit into the base unit 100, as shown in FIG. 1, and alternatively into the base unit 100' of FIG. 8 or 100" of FIG. 9. Likewise, when the sander head operates as the tool head, as shown in FIG. 11, it may fit into a base unit with a sliding battery pack as shown in FIGS. 1 and 11. It may also fit with the base units of FIGS. 8 and 9. This allows a user to have both a cordless and a corded system using the same tool heads.

Figure 10:
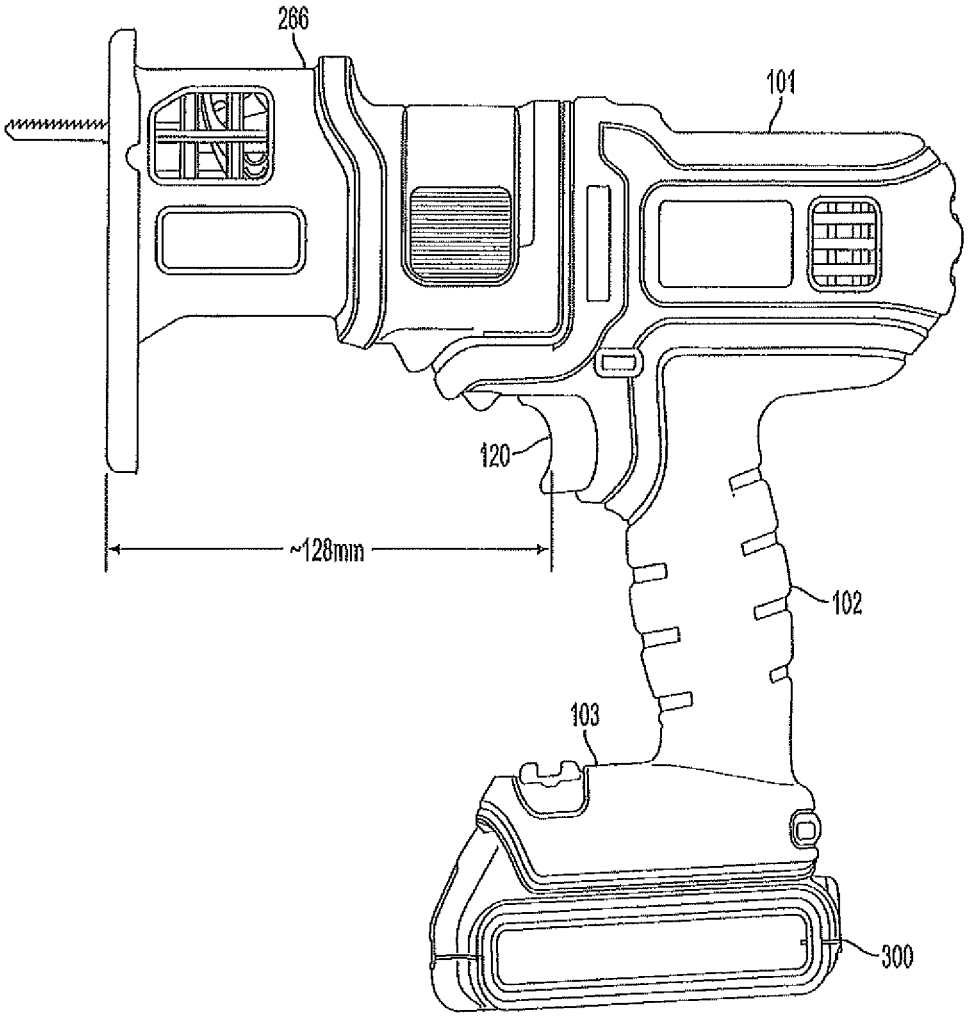
FIG. 10 is a side view of a power tool according to an exemplary embodiment of the invention with a jig saw head attached.
Figure 12:
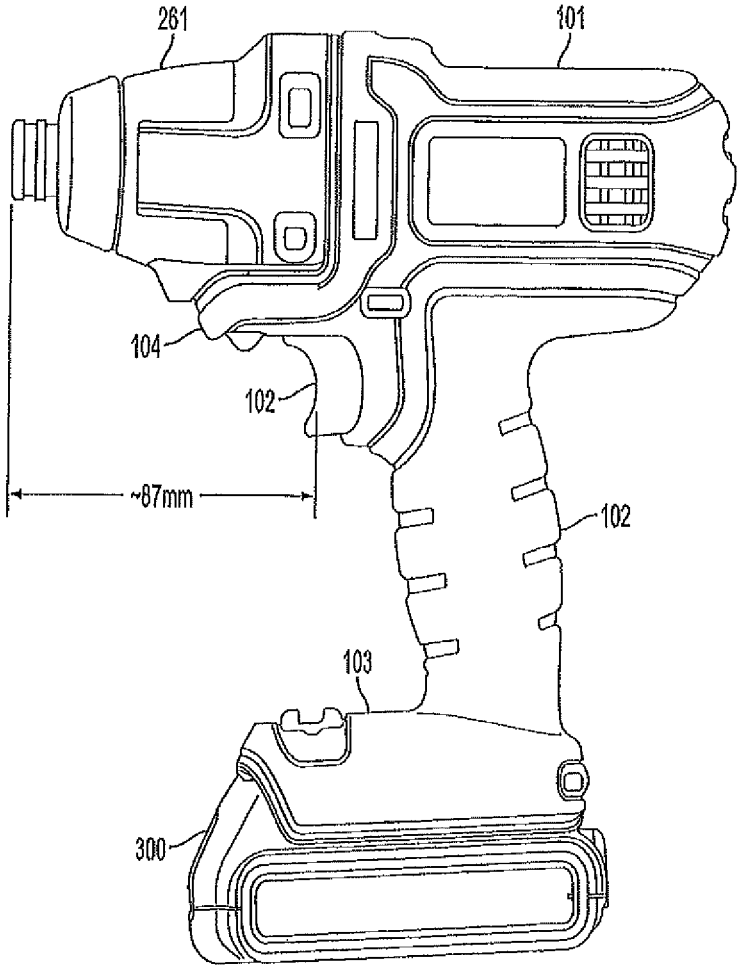
FIG. 12 is a side view of a power tool according to an exemplary embodiment of the invention with an impact driver head attached.
Figure 14:
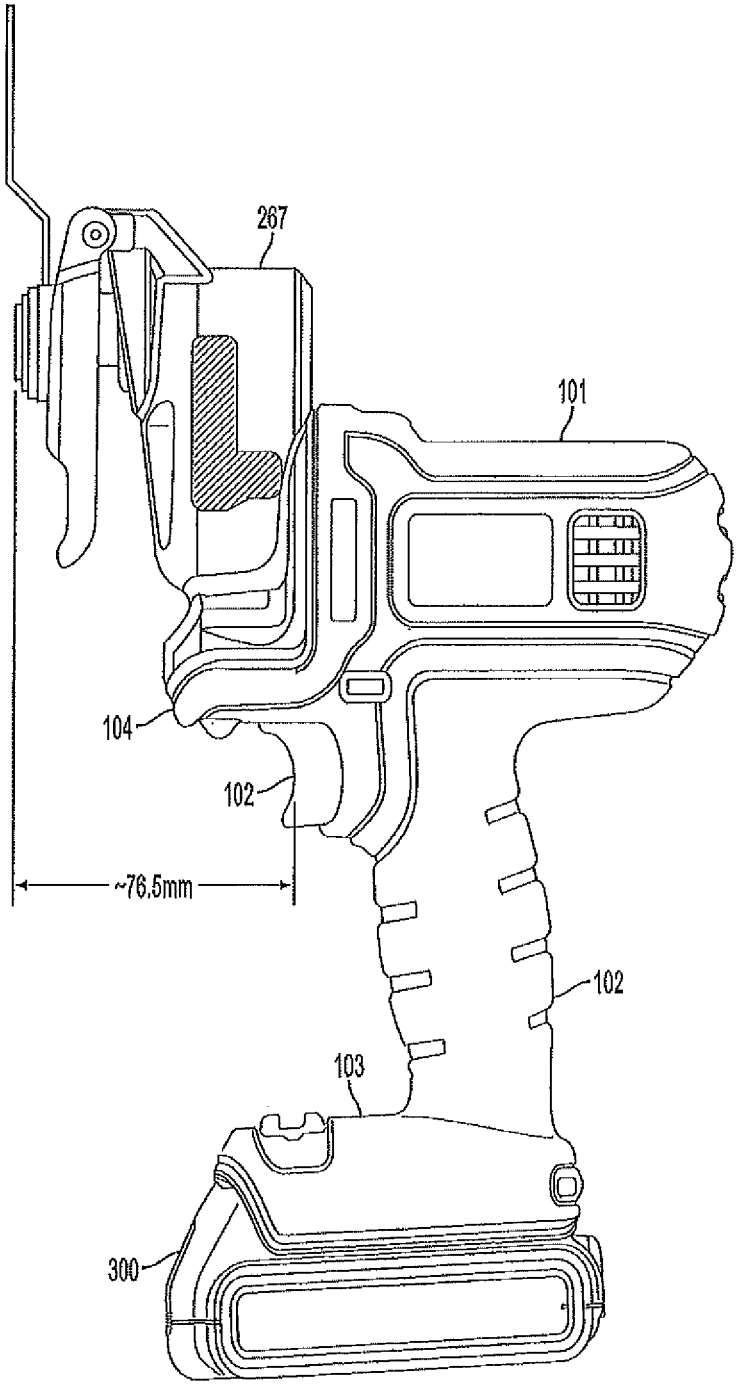
FIG. 14 is a side view of a power tool according to an exemplary embodiment of the invention with a oscillating tool head attached.
Figure 15:
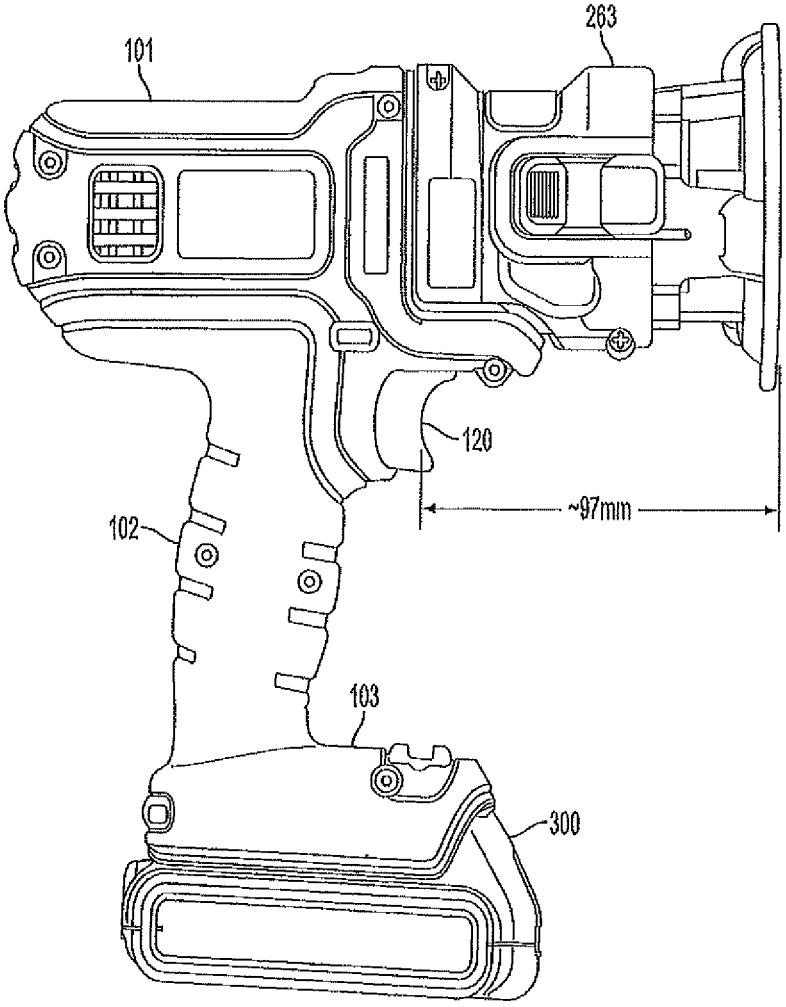
FIG. 15 is a side view of a power tool according to an exemplary embodiment of the invention with a router tool head attached.
Figure 16:
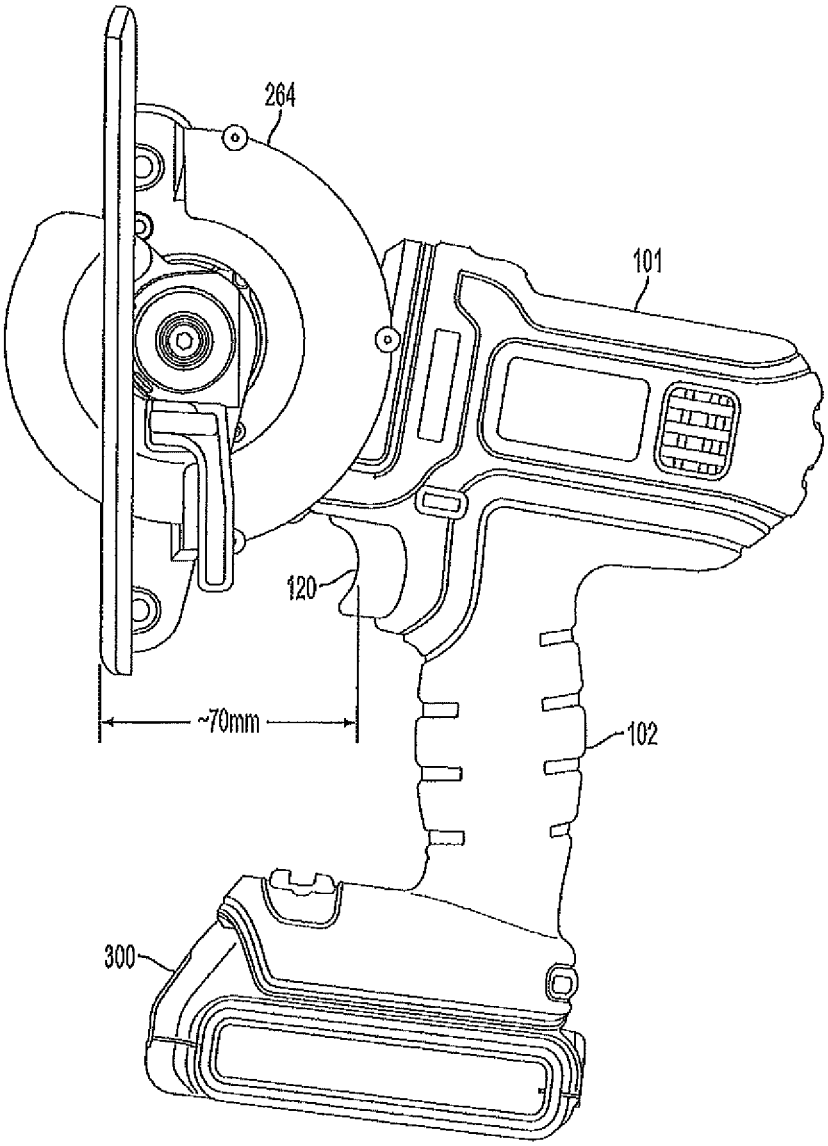
FIG. 16 is a side view of a power tool according to an exemplary embodiment of the invention with a trim saw head attached.
Figure 17:
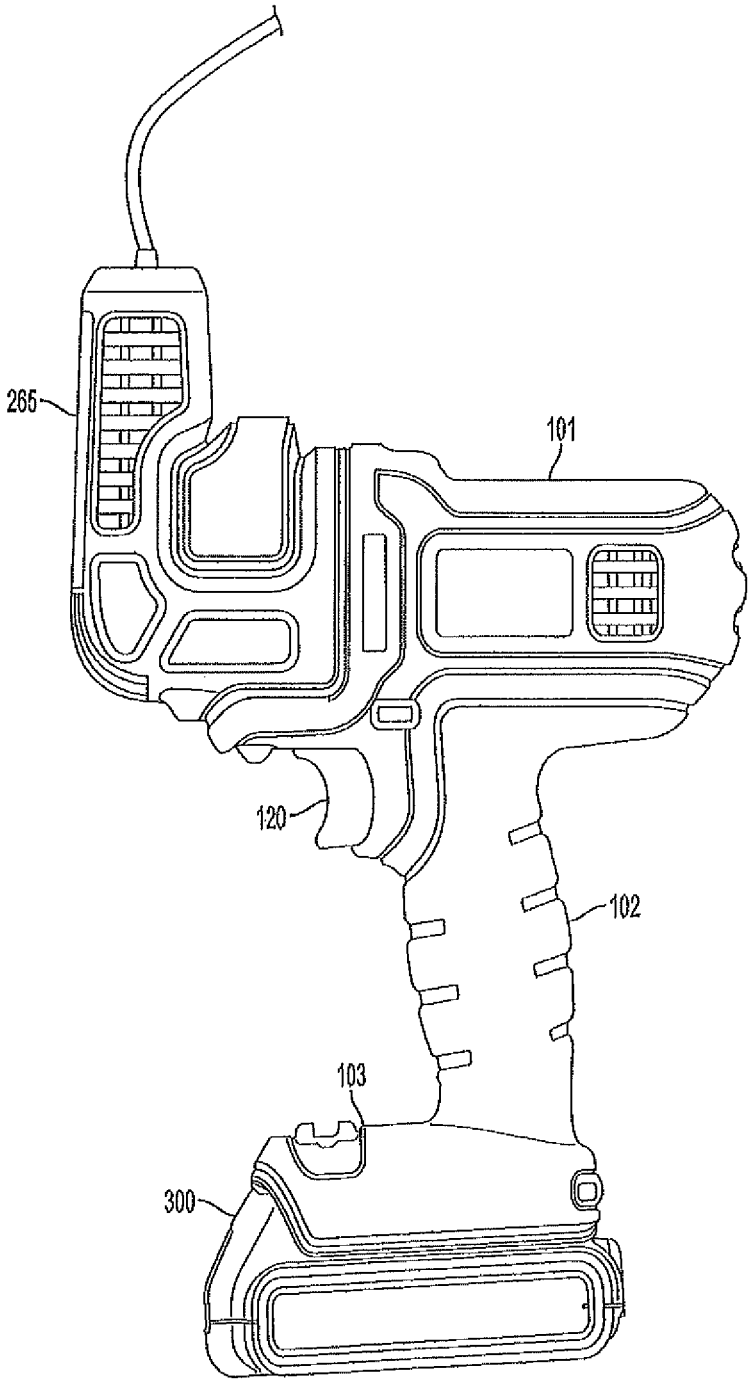
FIG. 17 is a side view of a power tool according to an exemplary embodiment of the invention with an inflator tool head attached.
Figure 18:
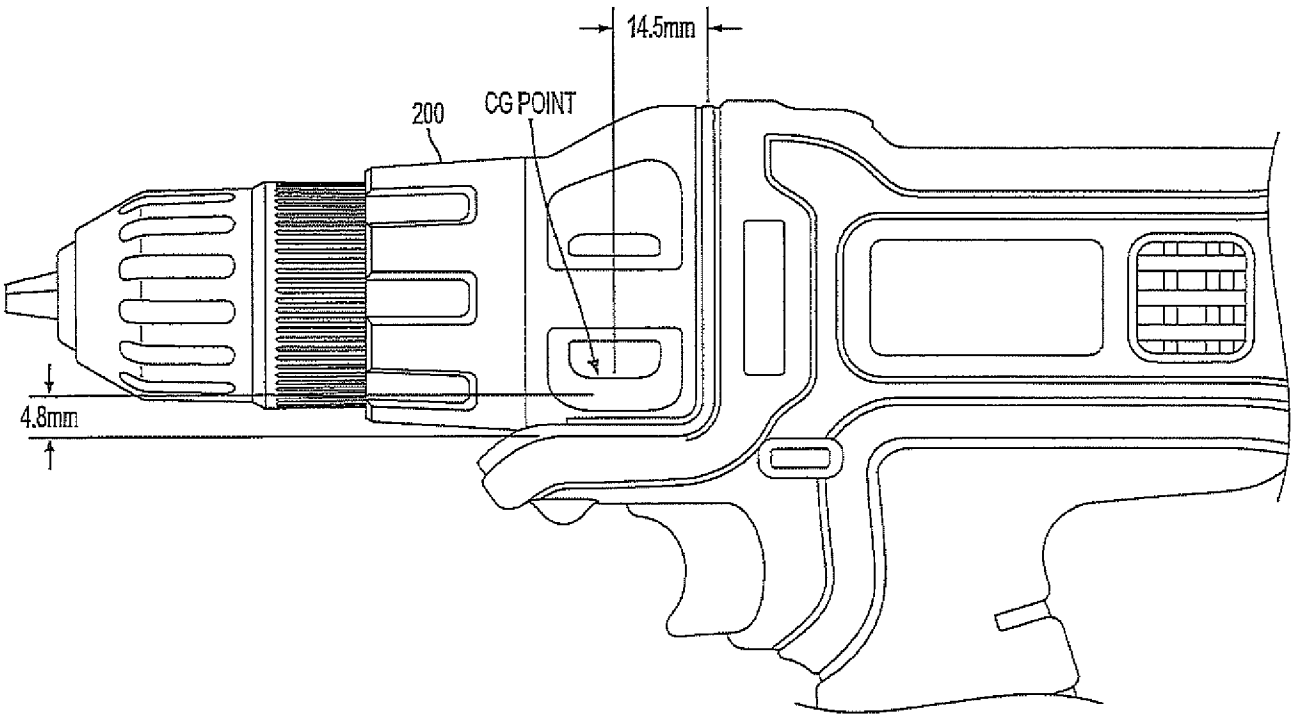
FIG. 18 is a close-up side view of the power tool of FIG. 1 showing the center of gravity.
Figure 19:
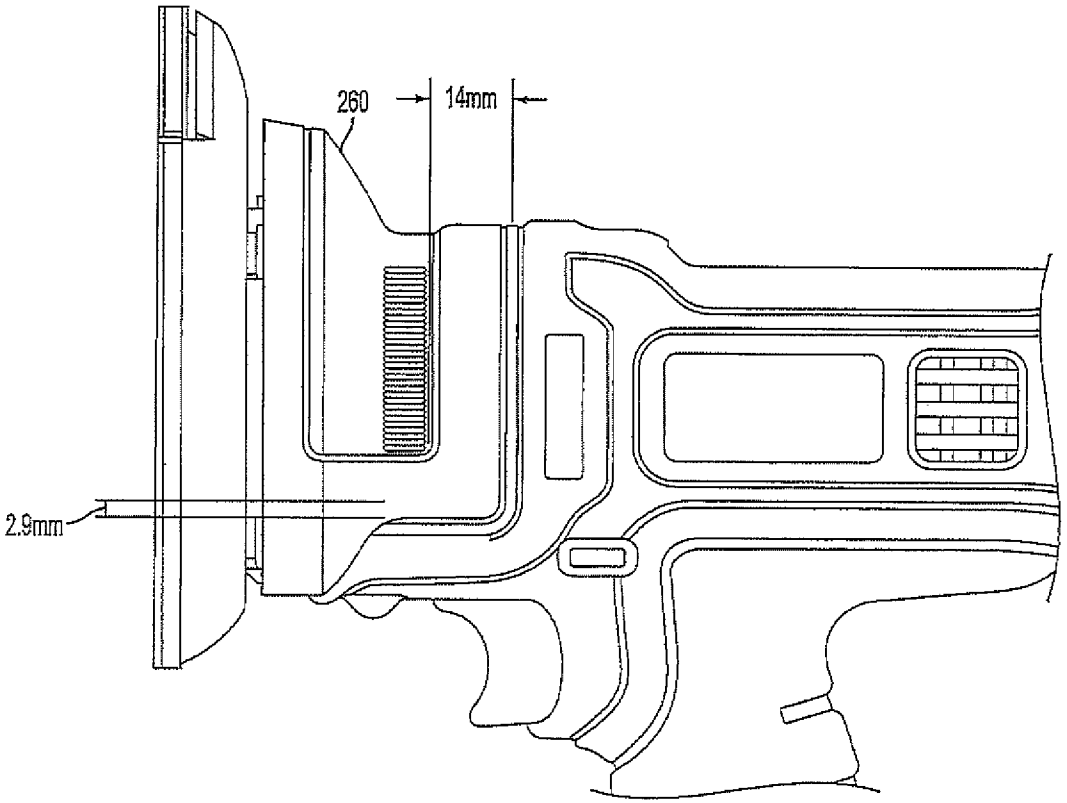
FIG. 19 is a close-up side view of the power tool of FIG. 11 showing the center of gravity.
Figure 20:
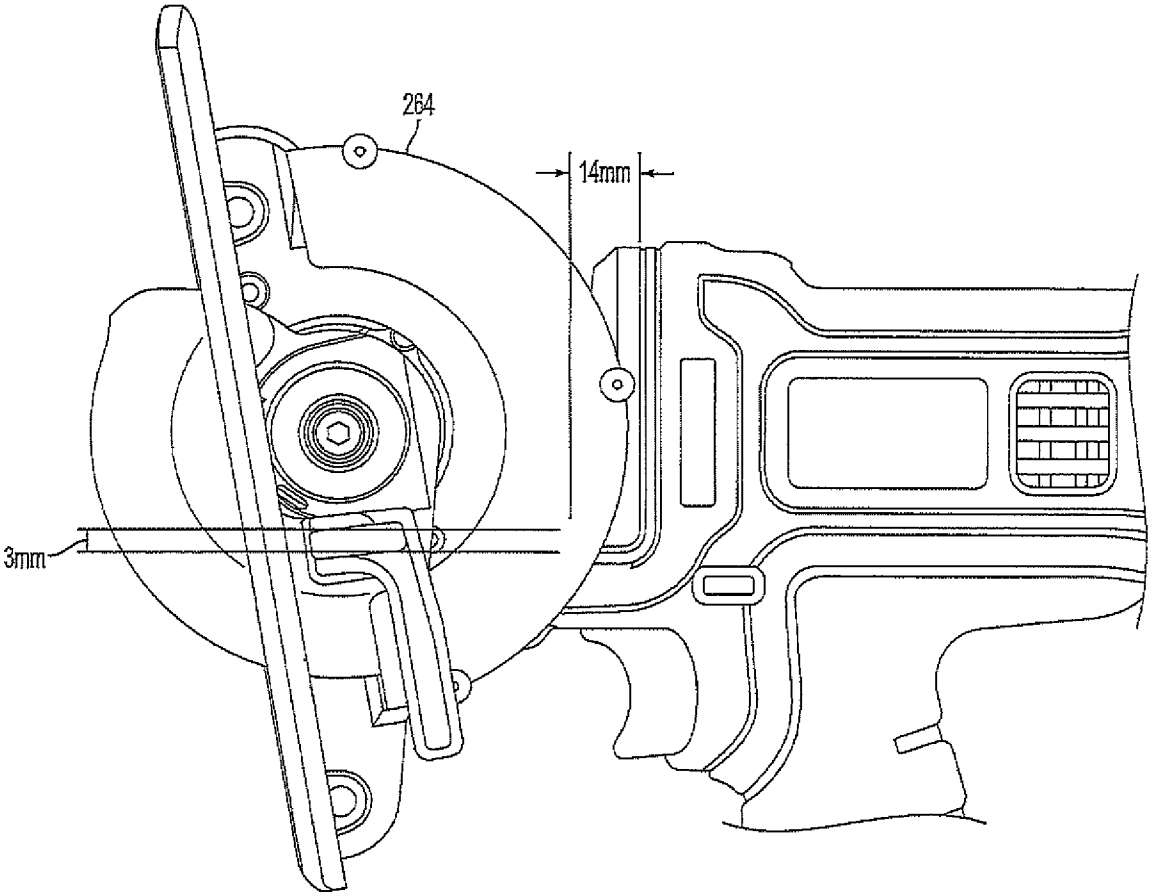
FIG. 20 is a close-up side view of the power tool of FIG. 16 showing the center of gravity.
Figure 21:
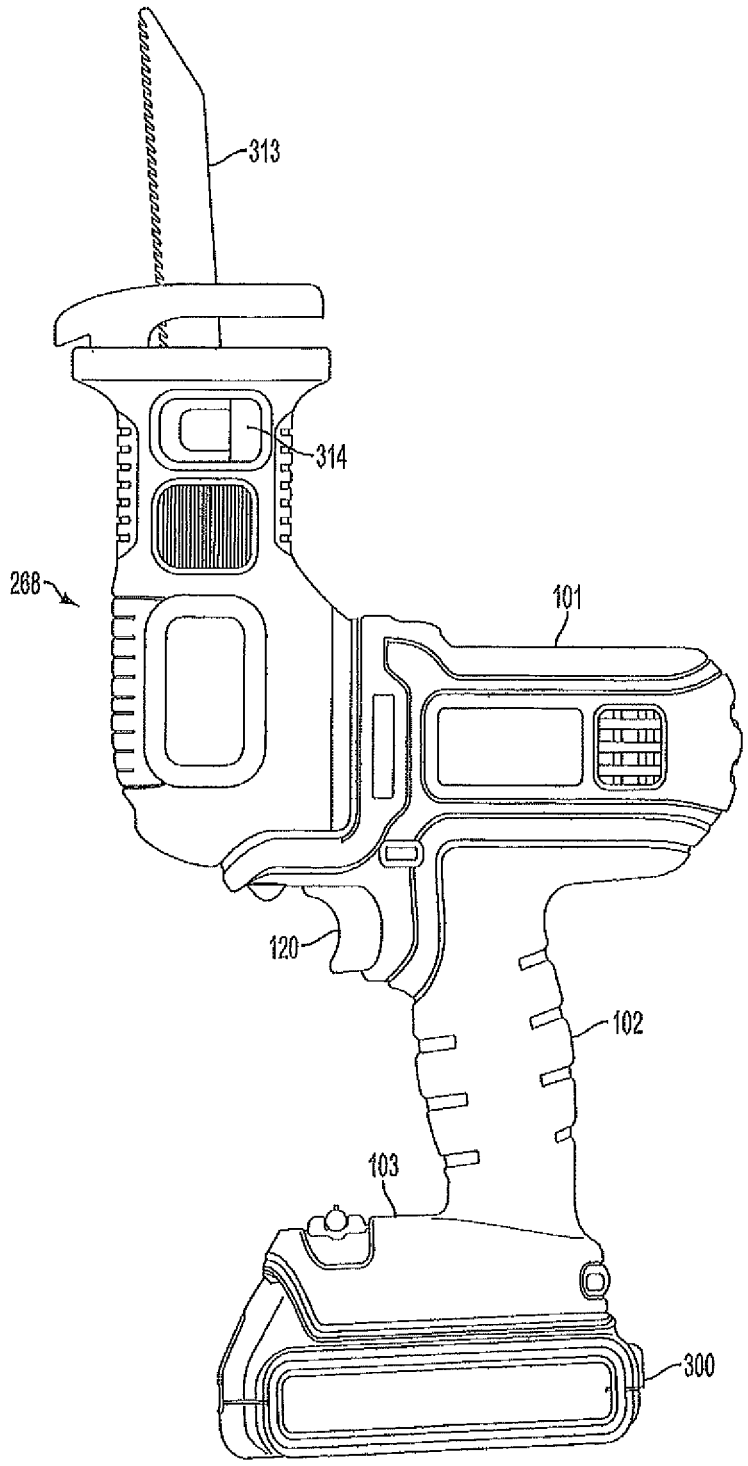
FIG. 21 is a side view of a power tool according to an exemplary embodiment of the invention with a reciprocating saw tool head attached.

FIGS. 10-17 and 21 illustrate the power tool system with a variety of different tool heads. Particularly, FIG. 10 illustrates a jig saw head 266 FIG. 11 shows a sander head 260; FIG. 12 illustrates an impact driver 261; FIG. 13 illustrates a two speed hammer drill 262; FIG. 14 shows an oscillating tool 267; FIG. 15 illustrates a router 263; FIG. 16 illustrates a trim saw 264; FIG. 17 illustrates an inflator 265; and FIG. 21 illustrates a reciprocating saw 268. Each of these tool heads 260-268 have a coupling section as shown in FIG. 5 for the drill head 200. That allows each of the tool heads 260-268 to similarly fit with a base unit with a sliding battery pack as shown in FIGS. 10-17 and 21 or one of the other base units as shown in FIGS. 8 and 9. Each of these tool heads 260-268 have a coupling section as shown in FIG. 5 for the drill head 200.

Figure 22:
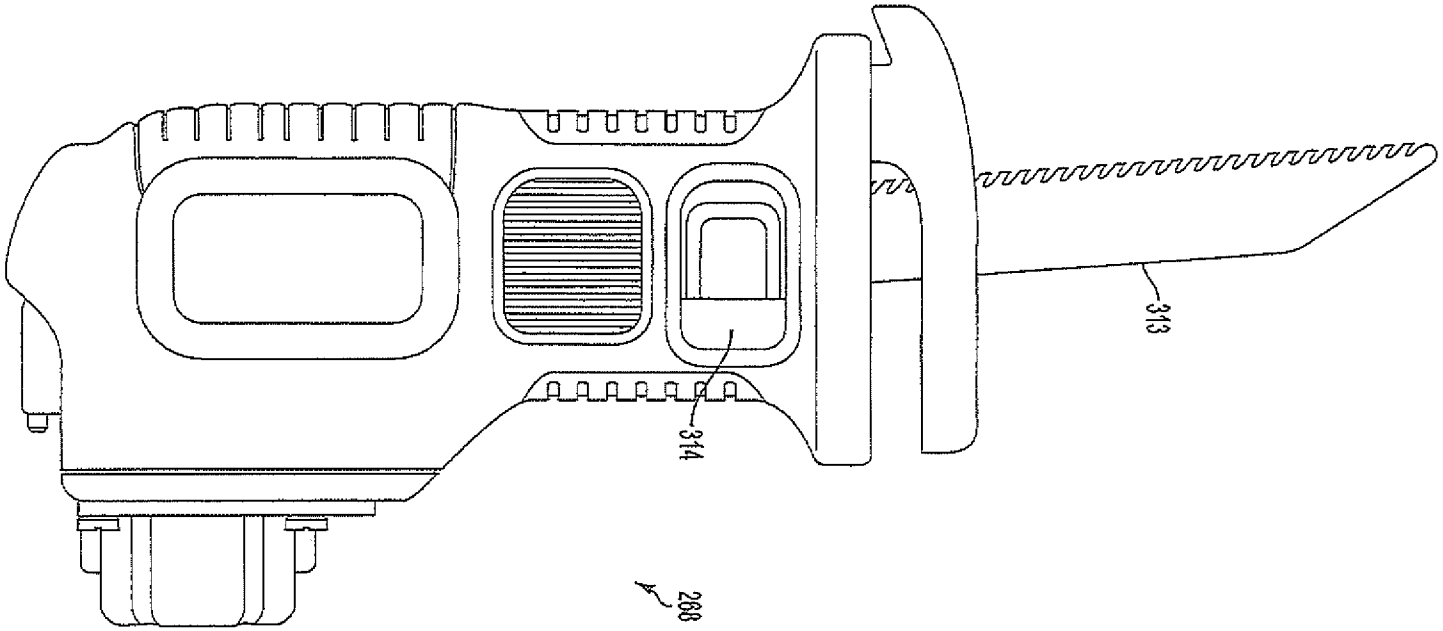
FIG. 22 is a side view of the reciprocating saw tool head of FIG. 21.
Figure 23:
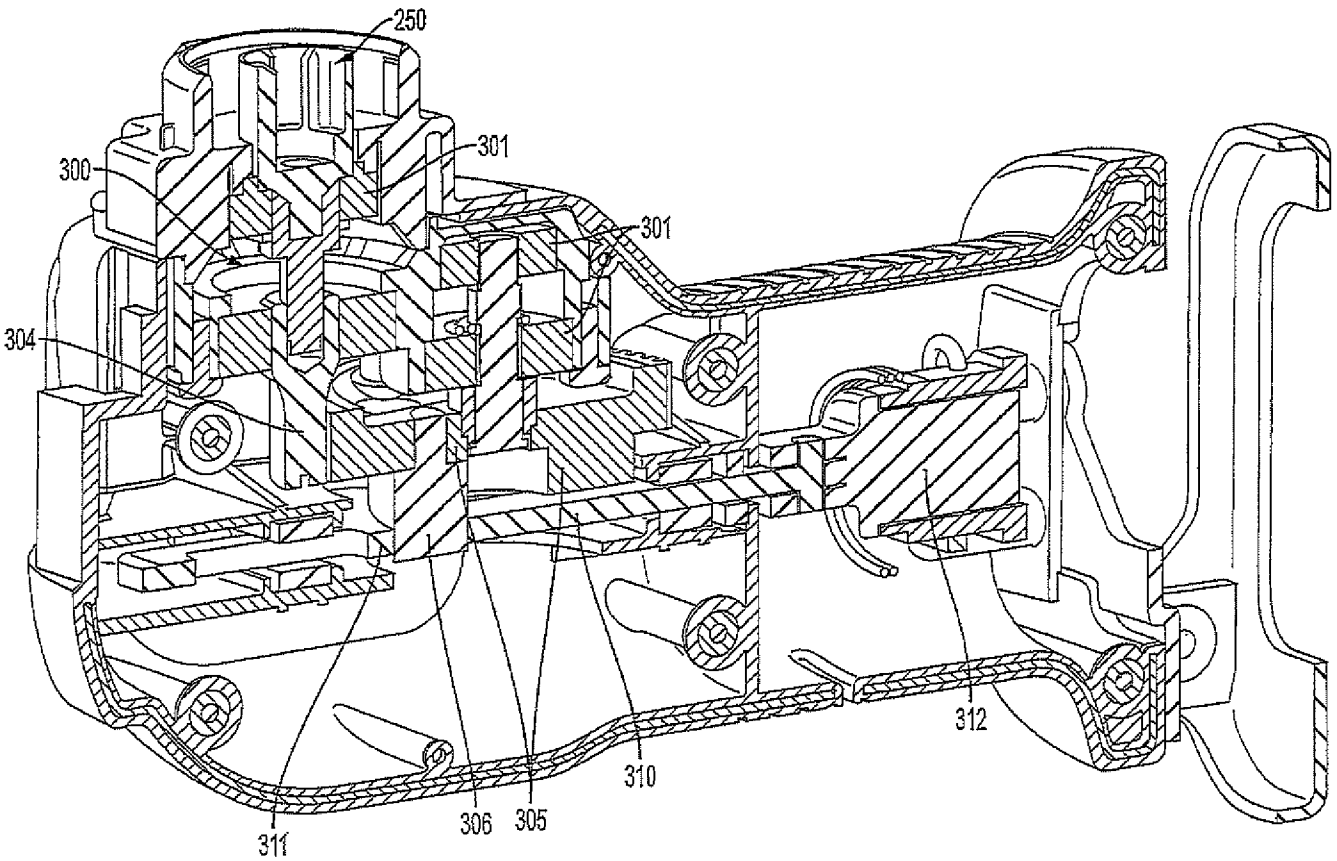
FIG. 23 is a cross-sectional view of the reciprocating saw tool head of FIG. 22.

A cut-away view of the reciprocating saw tool head 268 is shown in FIG. 23. The reciprocating saw tool head of the exemplary embodiment uses a scotch-yoke mechanism, but other known reciprocating saw tool heads may also be used. In the reciprocating saw tool head, drive power is transmitted to the tool head through the female coupler 250, as with the other tool heads. That drive power is transferred through a transmission 300, including various bearings 301 and shafts 302, to a pinion 304. The pinion 304 has teeth which mesh with a drive gear 305. The drive gear 305 has a roller/sleeve bearing 306. The roller/sleeve bearing 306 is offset from the central axis of the drive gear 305, so that it rotates in a circular pattern as the drive gear 305 is rotated. In turn, the roller/sleeve 306 bearing engages with a hole 311 in the reciprocating shaft 310. Thus, as the roller/sleeve bearing 306 moves forward, it pushes the reciprocating shaft 310 forward and when the roller/sleeve bearing moves backward it pulls the reciprocating shaft 310 backwards to impart a reciprocating motion on the reciprocating shaft 310. A front end of the reciprocating shaft 310 has a blade clamp 312 which holds a saw blade 313 and can be released by means of a saw blade release lever 314 (see FIGS. 21 and 22).

As discussed above, the design of the exemplary embodiment of the power tool system shown in the present application allows for the work surface to be spaced an efficient distance from the tool trigger. As shown in the figures, the drill driver 200, impact driver 261, sander 260, router 264, trim saw 265 and oscillating 267 tool heads each have distances from the action point of the trigger 120 to the work surfaces which are less than 110 mm. The two speed hammer drill 262 is has a trigger to work surface distance that is somewhat longer due to the additional gears needed to provide a hammer mode and a gear change. However, it still has a trigger to work surface distance of less than 150 mm.

As discussed above, it is contemplated that a tool head with a particular coupling may fit into more than one base unit. It is further contemplated that various tool heads may include a coupling with a lockout feature, so that they may fit into some base units and not others.

Figure 24:
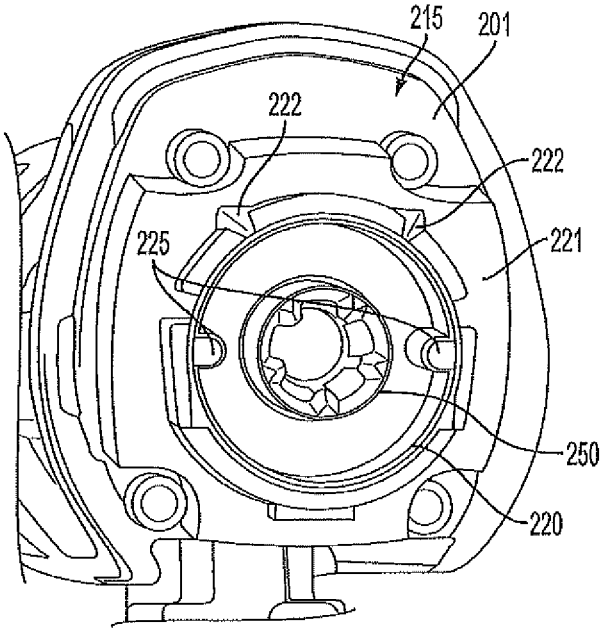
FIG. 24 is a perspective view of a coupling portion of the tool head according to another exemplary embodiment.
Figure 25:
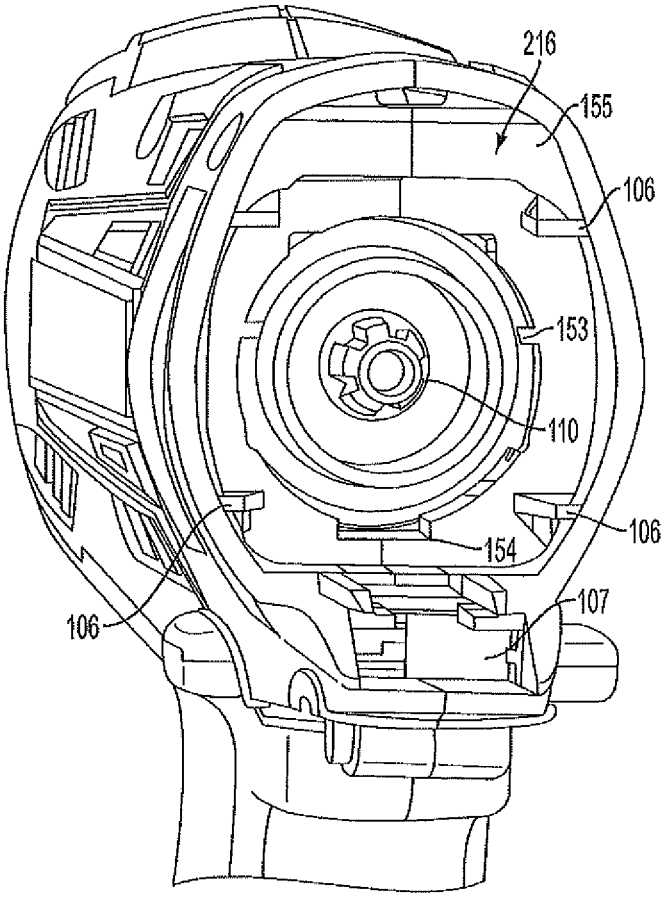
FIG. 25 is a perspective view of a coupling portion of a power tool base unit according to another exemplary embodiment.

For example, FIG. 24 is a perspective view of another exemplary embodiment of a coupling portion 215 for a tool head and FIG. 25 is a perspective view of another exemplary embodiment of a coupling portion for a base unit. The lockout tool head coupling portion 215 is the same as the coupling portion shown for tool head 200 in FIGS. 3 and 5, except that the lockout coupling portion 215 additionally includes lockout features 225. Similarly the base unit coupling portion 216 shown in FIG. 25 is the same as the coupling portion of the power tool base unit 100 shown in FIG. 4, except that the lockout base unit coupling portion 216 shown in FIG. 25 does not include recesses 157.

As shown, the coupling portion 215 shown in FIG. 24 includes a pair of lockout features 225 in the form of protrusions which protrude radially inwardly from the generally cylindrical second protrusion 220. When the tool head having the coupling portion 215 shown in FIG. 24 is attached to the base unit 100 shown in FIG. 1 with the coupling portion shown in FIG. 4, the lockout features 225 fit into the recesses 157. Since the lockout feature 225 is able to fit into the recesses 157, they do not block the tool head 216 from being inserted into the base unit 100 with a coupling portion as shown in FIG. 4. In this manner, a tool head with the coupling section 215 having a lockout feature 225 may be coupled to the base unit including a coupling section as shown in FIG. 4 and the tool may be operated in the same manner as when the tool head 200 with the coupling portion shown in FIGS. 3 and 5 is coupled to the base unit. Particularly, when a tool head with the lockout coupling portion 215 is engaged with the base unit, the male couple 110 and the female coupler 250 are engaged and the motor can drive the tool head through this connection.

On the other hand, a base unit having the lockout base unit coupling 216 shown in FIG. 25 has no recesses for receiving the lockout features 225. Accordingly, there is no space for the lockout features 225 to be received when a user attempts to couple a tool head with coupling section 215 into a base unit with lockout coupling section 216. Therefore, when a user tries to insert a tool head with the lockout coupling section 215 into a base unit with base unit lockout coupling section 216 shown in FIG. 25, the lockout features 225 contacts the second protrusion 220, a portion of which serves as an abutting member and prevents further insertion of the tool head with the lockout coupling section 215 into the base unit with the lockout coupling section 216. Particularly, in the embodiment, the lockout features 225 prevent the tool head coupler 250 from effectively engaging with the base unit coupler 110 and also prevents the spring 425 from becoming engaged with the recess 422. Accordingly, the tool head 215 with the lockout features 225 can be inserted only into a base unit with the recesses 157, as shown in FIG. 4, and cannot be inserted into a base unit without the recesses, as shown in FIG. 25.

The lockout tool coupling section 215 having lockout feature 225 may be added to any of the tool heads shown and described herein, such as the jig saw head 266 of FIG. 10, the sander head 260 of FIG. 11; the impact driver 261 of FIG. 12; the two speed hammer drill 262 of FIG. 13; the oscillating tool 267 of FIG. 14; the router 263 of FIG. 15; the trim saw 264 of FIG. 16; the inflator 265 of FIG. 17; and the reciprocating saw 268 of FIG. 21; or to other power, outdoor, cleaning or other tool heads which may be used with the system. Additionally, any of the base units (i.e., those of FIG. 1, 8 or 9) may include an interface with recesses 157 as shown in FIG. 4 or an interface without recesses 157 to make a lockout tool coupling 216, as shown in FIG. 25. Accordingly, for example, the base units 100 and 100" may have an interface with recesses 157 and base unit 100' may have an interface without the recesses 157. Alternatively, base units 100 may have an interface with recesses 157 and base unit 100' and 100" may have an interface without the recesses 157.

Figure 26:
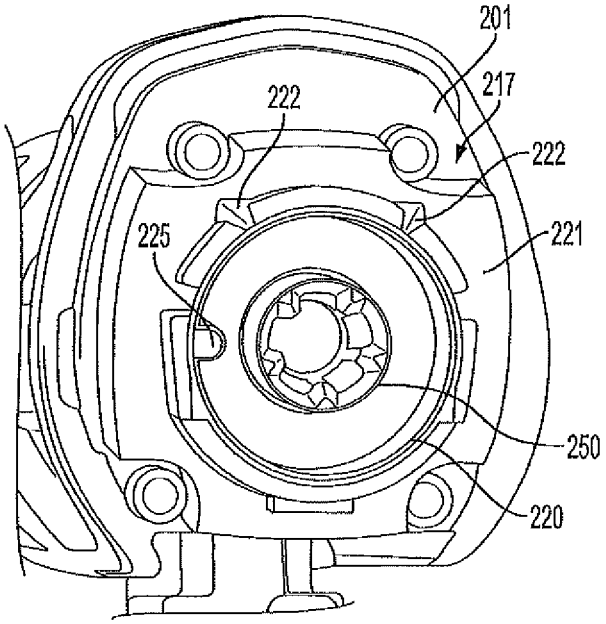
FIG. 26 is a perspective view of another exemplary embodiment of a coupling portion of a tool head.
Figure 27:
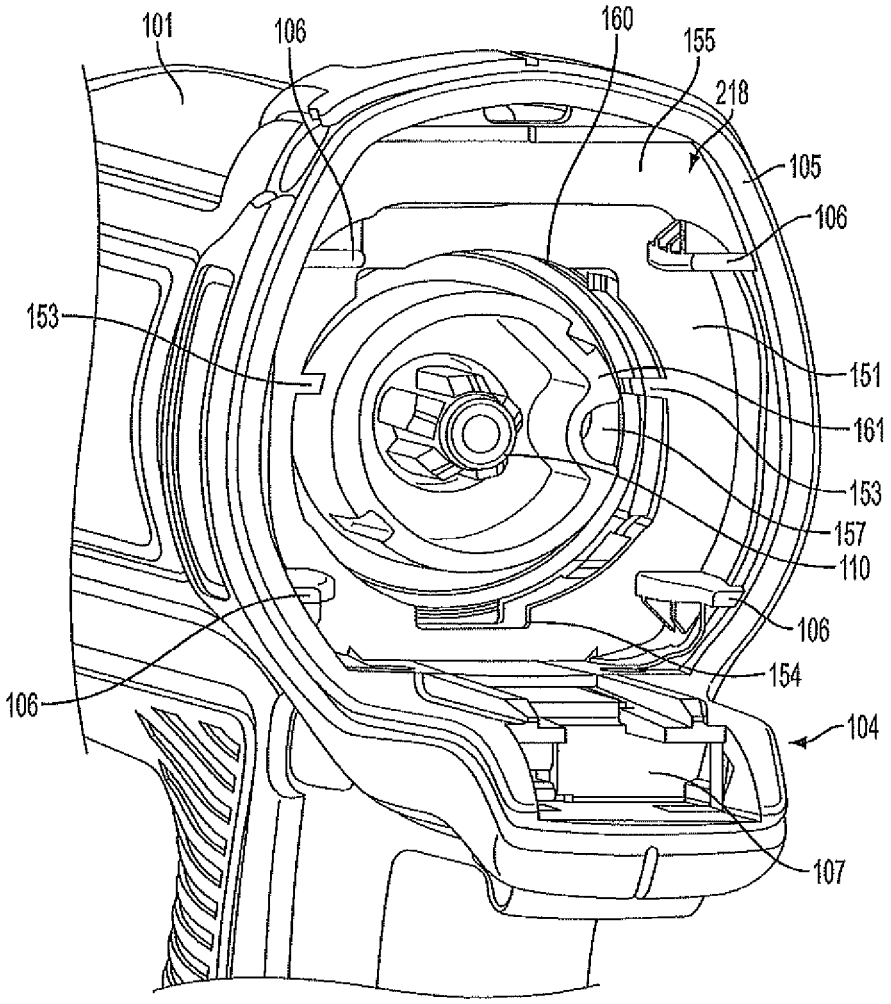
FIG. 27 is a perspective view of another exemplary embodiment of a coupling portion of a base unit.

It is further contemplated that there may be more than two types of head couplings and two types of base unit couplings so that there is a system of lock-outs with various tool head fitting various base units. The various base units may be different in how they are powered or in other aspects, such as the size of the motor or other components. For example, FIG. 26 shows another exemplary embodiment of a coupling section for a tool head and FIG. 27 shows another exemplary embodiment of a coupling section for a base unit in which there is a single lockout feature 225 and a single recess 157, respectively. The selective lockout tool head coupling section 217 shown in FIG. 26 is the same as the coupling section shown in FIGS. 5 and 24, except that the coupling section 217 of FIG. 26 includes a single lockout feature 225 (whereas FIG. 5 shows a coupling section with no lockout feature and FIG. 24 shows a coupling section with a pair of lockout features 225). Similarly the selective lockout base unit coupling section 218 shown in FIG. 27 is the same as the coupling portions shown in FIG. 4 and FIG. 25, except that the coupling section 218 of the base unit shown in FIG. 27 includes a single recess 157 for receiving a single lockout feature 225 (FIG. 4 having a pair of recesses 157 and FIG. 25 having no recesses 157). The coupling section 217 shown in FIG. 26 can be applied to any of the tool heads discussed herein and the coupling section 218 shown in FIG. 27 can be applied to any of the base units 100, 100', 100".

As can be appreciated, a tool head having a coupling section 217 with a single lockout feature 225, as shown in FIG. 26, can be removably coupled to a base unit that has a corresponding recess 157 for the single lockout feature 225. Accordingly, a tool head with the coupling section 217 shown in FIG. 26 (single lockout feature 225) can be coupled to a base unit with a single recess 157, as shown in FIG. 27, and can also be coupled to a base unit with a pair of recesses 157, as shown in FIG. 4. However, it cannot be coupled to a base unit having the coupling section 216 with no recesses, shown in FIG. 25. That is, it can be coupled to two of the three exemplary base unit coupling sections.

A tool head which includes a coupling section having no lockout features, as is shown in FIG. 5 does not require that the base unit coupling section have any recesses, but may also be coupled to base units with coupling sections that do include one or more recesses. Accordingly, a tool head with the coupling section of FIG. 5 may be coupled to a base unit with a coupling section with no recesses (FIG. 25), one recess 157 (FIG. 27) or two recesses (FIG. 4). On the other hand, a tool head which includes a coupling section having two lockout features 225, as is shown in FIG. 24, must be fit to a base unit which includes two recesses 157 for receipt of the two lockout features 225. Accordingly, a tool head which includes the coupling section shown in FIG. 24 having two lockout features 225 can be coupled with a base unit with the coupling section shown in FIG. 4 having two corresponding recesses 157 for receiving the two lockout features 225. However, it cannot be coupled with a base unit having a coupling section with only a single recess 157 (FIG. 27) or no recess 157 (FIG. 25) because at least one of the lockout features 225 will contact the second protrusion 220, a portion of which serves as an abutting member and prevent the male and female couplers 110, 250 from becoming engaged and/or the spring 425 from becoming engaged with the recess 422.

It is contemplated by this disclosure that there may be a variety of other power tool heads not specifically shown in the figures These other power tool heads may include, for example, outdoor power tool heads and/or cleaning power tool heads. A non-exhaustive list of such tool heads includes a rotary cutter, rotary tool, hammer drill, right angle drill, close quarter drill, powered scissors, jig saws, metal cutting saws, tile saws, random orbit sander, polishers, paint removal tools, laminate tools, cut-off tools, nailers, staplers, shears, impact wrenches, reversible angle drills, ratchet wrenches, spray guns, paint sprayers, a vacuum cleaner head, a barbecue cleaner, rotating and reciprocating brushes. Other tools may be adapted to run on the power transferred from the base units 100, 100', 100" to the tool head may also be used with the system, even if not specifically mentioned here. These tool heads may be constructed in a variety of manners and be powered by the power tool base units 100, 100', 100" described herein. The tool heads may be oriented in a variety of manners to provide the best access to a workpiece. For example, a rotary tool power tool head may rotate along the same or a parallel axis as the motor 400 or it may rotate along an axis perpendicular to the motor, or along an axis that is neither parallel nor perpendicular to the motor. Likewise, a reciprocating brush could reciprocate along the same or parallel axis as the motor 400, perpendicular to the motor, or at an angle to both. Various gear assemblies or other power transmission mechanism may transfer the power to provide the appropriate orientation.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied. Such variations are not to be regarded as a departure from the invention and all such modifications are intended to be included within the scope of the invention.

Example embodiments are provided. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A power tool system comprising:

an AC powered power tool base unit, the AC powered power tool base unit comprising a first housing, a first motor housed in the first housing and a first coupler operatively connected to and drivable by the first motor;

a DC powered power tool base unit, the DC powered power tool base unit comprising a second housing, a second motor housed in the second housing and a second coupler operatively connected to and drivable by the second motor;

a first tool attachment head and a second tool attachment head;

the first tool attachment head configured to be selectively connectable to the AC powered power tool base unit so as to receive motive power from the first coupler; and the first tool attachment head being configured to also be selectively connectable to the DC powered power tool base unit so as to receive motive power from the second coupler;

wherein the second tool attachment head is configured to be selectively connectable to the DC powered power tool base unit so as to receive motive power from the second coupler and is configured such that it is not connectable to the AC powered power tool base unit to receive motive power from the first coupler;

wherein the second tool attachment head includes a lockout protrusion configured to have the second tool attachment head not connectable to the AC powered tool base unit to receive power from the first coupler; and wherein the AC powered power tool base unit includes an abutting member which prevents the second tool attachment head from being coupled to the AC powered power tool base unit.

2. The power tool system of claim 1, wherein the first coupler and the second coupler are both either a male coupler with male splines or a female coupler including recess for receiving splines of a male coupler and each have the same number of splines or recesses for receiving the splines.

3. The power tool system of claim 1, wherein the DC powered power tool base unit includes a lockout recess which receives the lockout protrusion when the second tool attachment head is coupled to the DC powered power tool base unit.

4. The power tool system of claim 1, wherein the DC powered power tool base unit includes a handle.

5. The power tool system of claim 1, wherein the handle of the DC powered power tool base unit is disposed at an angle with respect to the second motor.

6. The power tool system of claim 2, wherein the DC powered power tool base unit includes a handle.

7. The power tool system of claim 2, wherein the handle of the DC powered power tool base unit is disposed at an angle with respect to the second motor.

8. A power tool system comprising:

an AC powered power tool base unit, the AC powered power tool base unit comprising a first housing, a first motor housed in the first housing and a first coupler operatively connected to and drivable by the first motor;

a DC powered power tool base unit, the DC powered power tool base unit comprising a second housing, a second motor housed in the second housing and a second coupler operatively connected to and drivable by the second motor;

a drill attachment head and a cutting attachment head;

wherein the drill attachment head is coupleable with both the AC powered power tool base unit and the DC powered power tool base unit such that an AC powered drill is formed when the drill attachment head is attached to the AC powered power tool base unit and a DC powered drill is formed when the drill attachment head is attached to the DC powered power tool base unit;

wherein the cutting attachment head is selectively coupleable with the DC powered power tool base unit such that a DC powered cutting tool is formed when the cutting attachment head is attached to the DC powered power tool base unit;

wherein the cutting attachment head is configured to be blocked from coupling with the AC powered power tool base unit, whereby the cutting attachment head is prevented from coupling to the AC powered power tool base unit to form an AC powered cutting tool;

wherein the cutting attachment head includes a lockout protrusion configured to have the second tool attachment head not connectable to the second power tool base unit to receive motive power from the second coupler; and wherein the AC powered power tool base unit includes an abutting member which prevents the cutting attachment head from being coupled to the AC powered power tool base unit.

9. The power tool system of claim 6, wherein the first coupler and the second coupler are both either a male coupler with male splines or a female coupler including recess for receiving splines of a male coupler and each have the same number of splines or recesses for receiving the splines.

10. The power tool system of claim 6, wherein the DC powered power tool base unit includes a lockout recess which receives the lockout protrusion when the cutting attachment head is coupled to the DC powered power tool base unit.

11. The power tool system of claim 8, wherein the DC powered power tool base unit includes a handle.

12. The power tool system of claim 8, wherein the handle of the DC powered power tool base unit is disposed at an angle with respect to the second motor.

13. The power tool system of claim 9, wherein the DC powered power tool base unit includes a handle.

14. The power tool system of claim 9, wherein the handle of the DC powered power tool base unit is disposed at an angle with respect to the second motor.

15. A power tool system comprising:

a first power tool base unit, the first power tool base unit comprising a first housing, a first motor housed in the first housing and a first coupler operatively connected to and drivable by the first motor;

a second power tool base unit, the second power tool base unit comprising a second housing, a second motor housed in the second housing and a second coupler operatively connected to and drivable by the second motor;

a first tool attachment head and a second tool attachment head;

the first tool attachment head configured to be selectively connectable to the first power tool base unit so as to receive motive power from the first coupler; and the first tool attachment head being configured to also be selectively connectable to the second power tool base unit so as to receive motive power from the second coupler;

wherein the second tool attachment head is configured to be selectively connectable to the first power tool base unit so as to receive motive power from the first coupler and is configured such that it is not connectable to the second power tool base unit to receive motive power from the second coupler;

wherein the first power tool base unit receives a first type of power source and the second power tool base unit receives a second type of power source and the first type of power source is different than the second type of power source;

wherein the first type of power source is a DC power source of a first voltage and the second type of power source is a DC power course of a second voltage;

wherein the second tool attachment head includes a lockout protrusion; and wherein the second power tool base unit includes an abutting member which prevents the second tool attachment head from being coupled to the second power tool base unit.

16. The power tool system of claim 15, wherein the first coupler and the second coupler are both either a male coupler with male splines or a female coupler including recess for receiving splines of a male coupler and each have the same number of splines or recesses for receiving the splines.

17. The power tool system of claim 15, wherein the first power tool base unit includes a lockout recess which receives the lockout protrusion when the second tool attachment head is coupled to the first power tool base unit.

18. The power tool system of claim 8, wherein the first power tool base unit includes a handle; and wherein the handle of the first power tool base unit is disposed at an angle with respect to the first motor.

19. The power tool system of claim 15, wherein the first type of power source comprises a removable battery pack.

20. The power tool system of claim 19, wherein the second type of power source comprises a removable battery pack.

* * * * *